US008948621B2

(12) United States Patent
Imazeki et al.

(10) Patent No.: US 8,948,621 B2
(45) Date of Patent: Feb. 3, 2015

(54) MANAGEMENT APPARATUS, IMAGE FORMING APPARATUS MAINTENANCE SYSTEM INCLUDING THE SAME, AND MANAGEMENT METHOD

(71) Applicants: Mikiko Imazeki, Kanagawa (JP); Yasushi Nakazato, Tokyo (JP); Akira Takehisa, Tokyo (JP); Jun Yamane, Kanagawa (JP)

(72) Inventors: Mikiko Imazeki, Kanagawa (JP); Yasushi Nakazato, Tokyo (JP); Akira Takehisa, Tokyo (JP); Jun Yamane, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 77 days.

(21) Appl. No.: 13/851,347

(22) Filed: Mar. 27, 2013

(65) Prior Publication Data

US 2013/0272723 A1 Oct. 17, 2013

(30) Foreign Application Priority Data

Apr. 13, 2012 (JP) ..... 2012-091728

(51) Int. Cl.
*G03G 15/00* (2006.01)

(52) U.S. Cl.
CPC ..... *G03G 15/5079* (2013.01)
USPC ..... 399/26

(58) Field of Classification Search
CPC ..... G03G 15/5033; G03G 15/5079
USPC ..... 399/8, 26
See application file for complete search history.

(56) References Cited

U.S. PATENT DOCUMENTS

| | | | | |
|---|---|---|---|---|
| 7,058,335 | B2 * | 6/2006 | Sugiura et al. | 399/100 |
| 2009/0322524 | A1 * | 12/2009 | Nakazato et al. | 340/540 |
| 2010/0098471 | A1 | 4/2010 | Satoh et al. | |
| 2011/0004419 | A1 * | 1/2011 | Ue et al. | 702/34 |
| 2011/0091226 | A1 | 4/2011 | Ishigaya et al. | |
| 2011/0170884 | A1 | 7/2011 | Yamane et al. | |
| 2012/0065885 | A1 | 3/2012 | Imazeki et al. | |
| 2012/0075659 | A1 | 3/2012 | Sawada et al. | |

FOREIGN PATENT DOCUMENTS

| | | |
|---|---|---|
| JP | 2009-069208 | 4/2009 |
| JP | 2010-032758 | 2/2010 |
| JP | 2010-113103 | 5/2010 |

* cited by examiner

*Primary Examiner* — Gregory H Curran
(74) *Attorney, Agent, or Firm* — Oblon, Spivak, McClelland, Maier & Neustadt, L.L.P.

(57) ABSTRACT

A management apparatus communicates, via a communication network, with image forming apparatuses, and includes an information reception device that receives, from each of the image forming apparatuses via the network, prediction-use information useful for predicting a latent image carrier surface contamination level due to discharge products generated during charging, a contamination level prediction device that, on the basis of the received prediction-use information, predicts the latent image carrier surface contamination level of the image forming apparatus corresponding to the prediction-use information, and an instruction transmission device that, if the predicted latent image carrier surface contamination level exceeds a predetermined allowable range, transmits an execution instruction to execute a contamination reduction operation of reducing the contamination of the surface of the latent image carrier due to the discharge products to the image forming apparatus corresponding to the latent image carrier surface contamination level via the network.

10 Claims, 8 Drawing Sheets

MANAGEMENT APPARATUS, IMAGE FORMING APPARATUS MAINTENANCE SYSTEM INCLUDING THE SAME, AND MANAGEMENT METHOD

CROSS-REFERENCE TO RELATED APPLICATION

This patent application is based on and claims priority pursuant to 35 U.S.C. §119 to Japanese Patent Application No. 2012-091728, filed on Apr. 13, 2012, in the Japan Patent Office, the entire disclosure of which is hereby incorporated by reference herein.

BACKGROUND OF THE INVENTION

1. Field of the Invention

The present invention relates to a management apparatus, an image forming apparatus maintenance system including multiple image forming apparatuses, such as copiers, printers, and facsimile machines, and a management apparatus communicably connected to the image forming apparatuses via a communication network, and a management method that manages multiple image forming apparatuses via a communication network.

2. Description of the Related Art

In an electrophotographic image forming apparatus, a surface of a photoconductor serving as a latent image carrier is charged by a charging device and exposed to light by an exposure device to form an electrostatic latent image, and a visible image is formed on the electrostatic latent image with charged fine particles of toner by a development device. The charging device may be either a non-contact charging device or a contact charging device. The non-contact charging device includes, for example, a corona charging device which uses corona discharge generated by a relatively high voltage applied to a wire electrode. The contact charging device charges the surface of the photoconductor by bringing a voltage-applied conductive brush or roller into contact with the surface of the photoconductor.

The non-contact charging device generates, as discharge products, a relatively large amount of ozone and nitrogen oxide, causing an abnormal image. Meanwhile, the contact charging device produces a smaller amount of ozone and nitrogen oxide than the non-contact charging device, but causes wear of a photoconductor surface layer resulting in a reduction in life of the photoconductor and variation in charging performance due to the usage environment. Based on a comparison of the features of the two types of charging devices, the non-contact charging device is recognized as the better choice in some cases.

The discharge products generated by the use of the charging device reduce the electrical resistance of the surface of the photoconductor and contaminate the charging device, thereby causing insulation failure and discharge failure. Particularly, when the image forming apparatus is placed at rest in a high-humidity environment for a certain period of time after extended use of the charging device, foreign conductive substances, such as water-soluble matter in the discharge products generated by the charging device, adhere to and contaminate the surface of the photoconductor. With this contamination of the surface of the photoconductor, the charge on the surface of the photoconductor formed with the electrostatic latent image moves along the surface of the photoconductor, thereby causing an abnormal image, such as a tailing image.

The image forming apparatus may be configured such that, if the values of the rest time following the last image forming operation, the use history of the photoconductor, the use history of the charging device, and the relative humidity near the photoconductor exceed their respective thresholds, a preliminary photoconductor rotation operation is performed for a predetermined time when the image forming apparatus is powered on or returns from an energy-saving mode. With the preliminary photoconductor rotation operation, the discharge products adhering to the surface of the photoconductor are scraped off by a developer or a cleaning member, thereby suppressing the occurrence of an abnormal image.

Alternatively, the image forming apparatus may be configured to supply a direct-current voltage lower than a discharge starting voltage to a charging roller, measure a direct current value by using a measuring circuit, and determine, on the basis of the measurement result, whether or not a tailing image would be formed on a photoconductor drum. If it is determined that a tailing image would be formed on a photoconductor drum, the image forming apparatus may execute a tailing image suppression mode in which a heater is turned on to reduce the relative humidity near the surface of the photoconductor drum and thereby suppress the tailing image.

Still alternatively, the image forming apparatus may be configured to, in an anti-aging operation of polishing the surface of the photoconductor drum by bringing a cleaning member into contact with the rotating photoconductor drum carrying toner, determine the level of possibility of the tailing image from the result of reading a density detection pattern image formed on the photoconductor drum before the anti-aging operation, and change the length of the anti-aging operation in accordance with the level of possibility. In the image forming apparatus, the discharge products adhering to the surface of the photoconductor drum are scraped off by the developer or the cleaning member in the anti-aging operation, thereby suppressing the occurrence of an abnormal image.

In general, to predict the occurrence of an abnormal image such as a tailing image due to the generation of the discharge products, a photoconductor surface contamination level is predicted from internal information of the image forming apparatus, i.e., information useful for the prediction. The photoconductor surface contamination level is an index value indicating the level of contamination of the surface of the photoconductor due to the discharge products. Then, if the photoconductor surface contamination level exceeds a specified value, it is determined that the abnormal image due to the generation of the discharge products would occur in the near feature, and a process of reducing the contamination of the surface of the photoconductor is performed. The process corresponds to, for example, the preliminary photoconductor rotation operation or the anti-aging operation described above.

If the accuracy of predicting the photoconductor surface contamination level is improved, the accuracy of preventing the occurrence of an abnormal image due to the generation of the discharge products is improved. Further, if the accuracy of predicting the photoconductor surface contamination level is improved, it is possible to perform the process of reducing the contamination of the surface of the photoconductor as close as possible to actual occurrence of an abnormal image. Due to the contamination reduction process, therefore, the deterioration of the surface of the photoconductor is suppressed.

The process of predicting the occurrence of an abnormal image (i.e., the photoconductor surface contamination level) due to the generation of the discharge products has been improved by continuous research and development and continuous data collection, and new prediction processes capable of performing more accurate prediction have been proposed. The latest prediction process thus improved or newly proposed is capable of performing more accurate prediction than past prediction processes, and thus is desired to be applied to existing image forming apparatuses already on the market.

The process of predicting the photoconductor surface contamination level due to the generation of the discharge products may be performed inside individual image forming apparatuses. To apply a new prediction process to image forming apparatuses released on the market before the improvement and development of the new prediction process, however, it is necessary to, for example, individually visit locations where the image forming apparatuses are installed and perform updating work for applying the new prediction process to the image forming apparatuses. Since a huge number of image forming apparatuses are on the market, it is difficult to individually visit each and every location where the image forming apparatuses are installed and perform the work for applying the new prediction process to the image forming apparatuses.

Meanwhile, the image forming apparatus may be configured to be communicable with an external apparatus via a communication network. If the image forming apparatus is thus configured, it is possible to perform the updating work for applying the new prediction process by remote control via the communication network, with no need to individually visit the locations with the image forming apparatuses installed. To appropriately perform the updating work, however, it is preferable to perform the updating work with the image forming operation stopped. The updating work, therefore, causes a downtime during which the image forming operation is prevented. Such a downtime reduces image formation productivity, and thus is desired to be avoided as much as possible.

Moreover, among the various ways of predicting a variety of abnormalities occurring in the image forming apparatus, the prediction of the latent image carrier surface contamination level due to the generation of the discharge products is particularly affected by the usage environment of the individual image forming apparatus. Since individual image forming apparatuses are used in different usage environments, it is difficult to improve the prediction accuracy by conducting reproductive experiments in, for example, a laboratory. To improve the accuracy of predicting the latent image carrier surface contamination level, therefore, it is desired to collect information useful for the prediction (particularly, information useful for the prediction corresponding to a period immediately before the occurrence of an abnormal image due to the discharge products) in the image forming apparatus operating in an actual usage environment, and to feed back the information to the prediction process. Further, it is desired to promptly perform the feedback upon collection of the information. If the feedback to the prediction process is performed every time the information useful for the prediction is collected, however, the frequency of updating the prediction process is increased, since the time for collecting the information substantially varies among image forming apparatuses. This configuration therefore causes an increase in frequency of downtime and a further reduction in image formation productivity.

SUMMARY OF THE INVENTION

The present invention describes a novel management apparatus that, in one example, communicates, via a communication network, with multiple image forming apparatuses each uniformly charging a surface of a latent image carrier to a predetermined charge potential, forming an electrostatic latent image on the charged surface of the latent image carrier, and developing the electrostatic latent image and forming a visible image to be transferred onto a recording medium. The management apparatus includes a prediction-use information reception device, a latent image carrier surface contamination level prediction device, and an execution instruction transmission device. The prediction-use information reception device is configured to receive, from each of the multiple image forming apparatuses via the communication network, prediction-use information useful for predicting a latent image carrier surface contamination level due to discharge products generated during the charging. The latent image carrier surface contamination level prediction device is configured to execute, on the basis of the received prediction-use information, a prediction process of predicting the latent image carrier surface contamination level of the image forming apparatus corresponding to the prediction-use information. If the predicted latent image carrier surface contamination level exceeds a predetermined allowable range, the execution instruction transmission device is configured to transmit an execution instruction to execute a contamination reduction operation of reducing the contamination of the surface of the latent image carrier due to the discharge products to the image forming apparatus corresponding to the latent image carrier surface contamination level via the communication network.

The present invention further describes a novel image forming apparatus maintenance system that, in one example, includes multiple image forming apparatuses and a management apparatus configured to communicate with the multiple image forming apparatuses via a communication network. Each of the multiple image forming apparatuses includes a rotary latent image carrier, a charging device, an electrostatic latent image forming device, a development device, a prediction-use information acquisition and transmission device, and a contamination reduction device. The charging device is configured to uniformly charge a surface of the latent image carrier to a predetermined charge potential. The electrostatic latent image forming device is configured to form an electrostatic latent image on the charged surface of the latent image carrier. The development device is configured to develop the electrostatic latent image and form a visible image to be transferred onto a recording medium. The prediction-use information acquisition and transmission device is configured to acquire, at predetermined intervals, prediction-use information useful for predicting a latent image carrier surface contamination level due to discharge products generated during the charging, and externally transmit the prediction-use information. The contamination reduction device is configured to receive an externally transmitted execution instruction to execute a contamination reduction operation, and execute, in accordance with the execution instruction, the contamination reduction operation of reducing the contamination of the surface of the latent image carrier due to the discharge products. The management apparatus includes a prediction-use information reception device, a latent image carrier surface contamination level prediction device, and an execution instruction transmission device. The prediction-use information reception device is configured to receive the prediction-use information transmitted from each of the multiple image forming apparatuses via the communication network. The latent image carrier surface contamination level prediction device is configured to execute, on the basis of the received prediction-use information, a prediction process of predicting the latent image carrier surface contamination level of the image forming apparatus corresponding to the prediction-use information. If the predicted latent image carrier surface contamination level exceeds a predetermined allowable range, the execution instruction transmission device is configured to transmit the execution instruction to execute the contamination reduction operation to the image forming apparatus corresponding to the latent image carrier surface contamination level via the communication network.

The management apparatus may further include a prediction process updating device configured to update the prediction process on the basis of the prediction-use information in a predetermined period preceding the occurrence of an abnormal image caused by the contamination of the surface of the latent image carrier by the discharge products.

The prediction-use information acquisition and transmission device may acquire the prediction-use information at least at one of when the image forming apparatus is powered on, when the image forming apparatus returns from an energy-saving mode, and when a predetermined specified time lapses after the completion of an image forming operation and before the start of a subsequent image forming operation.

The latent image carrier surface contamination level prediction device may perform multiple weak identification processes of calculating preliminary prediction values from the received prediction-use information, and predict the latent image carrier surface contamination level by using the calculated preliminary prediction values.

The latent image carrier surface contamination level prediction device may weight the calculated preliminary prediction values, and predict the latent image carrier surface contamination level by using the weighted preliminary prediction values.

The latent image carrier surface contamination level prediction device may derive weighted prediction results from the weighted preliminary prediction values, and predict the latent image carrier surface contamination level on the basis of combinations of the weighted prediction results.

If the predicted latent image carrier surface contamination level exceeds the predetermined allowable range, the execution instruction transmission device may calculate a length of operation of the contamination reduction operation on the basis of the latent image carrier surface contamination level, and transmit the execution instruction to execute the contamination reduction operation for the calculated length of operation to the image forming apparatus corresponding to the latent image carrier surface contamination level.

The management apparatus may further include a modification device configured to modify, for each of the image forming apparatuses, the process of calculating the length of operation of the contamination reduction operation.

The management apparatus may further include a relationship information storage device configured to store relationship information concerning the relationship between the latent image carrier surface contamination level and the length of operation of the contamination reduction operation according to the latent image carrier surface contamination level. If the predicted latent image carrier surface contamination level exceeds the predetermined allowable range, the execution instruction transmission device may calculate the length of operation of the contamination reduction operation on the basis of the latent image carrier surface contamination level and the stored relationship information.

The present invention further describes a novel management method that, in one example, manages, via a communication network, multiple image forming apparatuses each uniformly charging a surface of a latent image carrier to a predetermined charge potential, forming an electrostatic latent image on the charged surface of the latent image carrier, and developing the electrostatic latent image and forming a visible image to be transferred onto a recording medium. The management method includes receiving, from each of the multiple image forming apparatuses via the communication network, prediction-use information useful for predicting a latent image carrier surface contamination level due to discharge products generated during the charging; executing, on the basis of the received prediction-use information, a prediction process of predicting the latent image carrier surface contamination level of the image forming apparatus corresponding to the prediction-use information; calculating, if the predicted latent image carrier surface contamination level exceeds a predetermined allowable range, a length of operation of a contamination reduction operation which reduces the contamination of the surface of the latent image carrier due to the discharge products, on the basis of the latent image carrier surface contamination level; and transmitting an execution instruction to execute the contamination reduction operation for the calculated length of operation to the image forming apparatus corresponding to the latent image carrier surface contamination level via the communication network.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
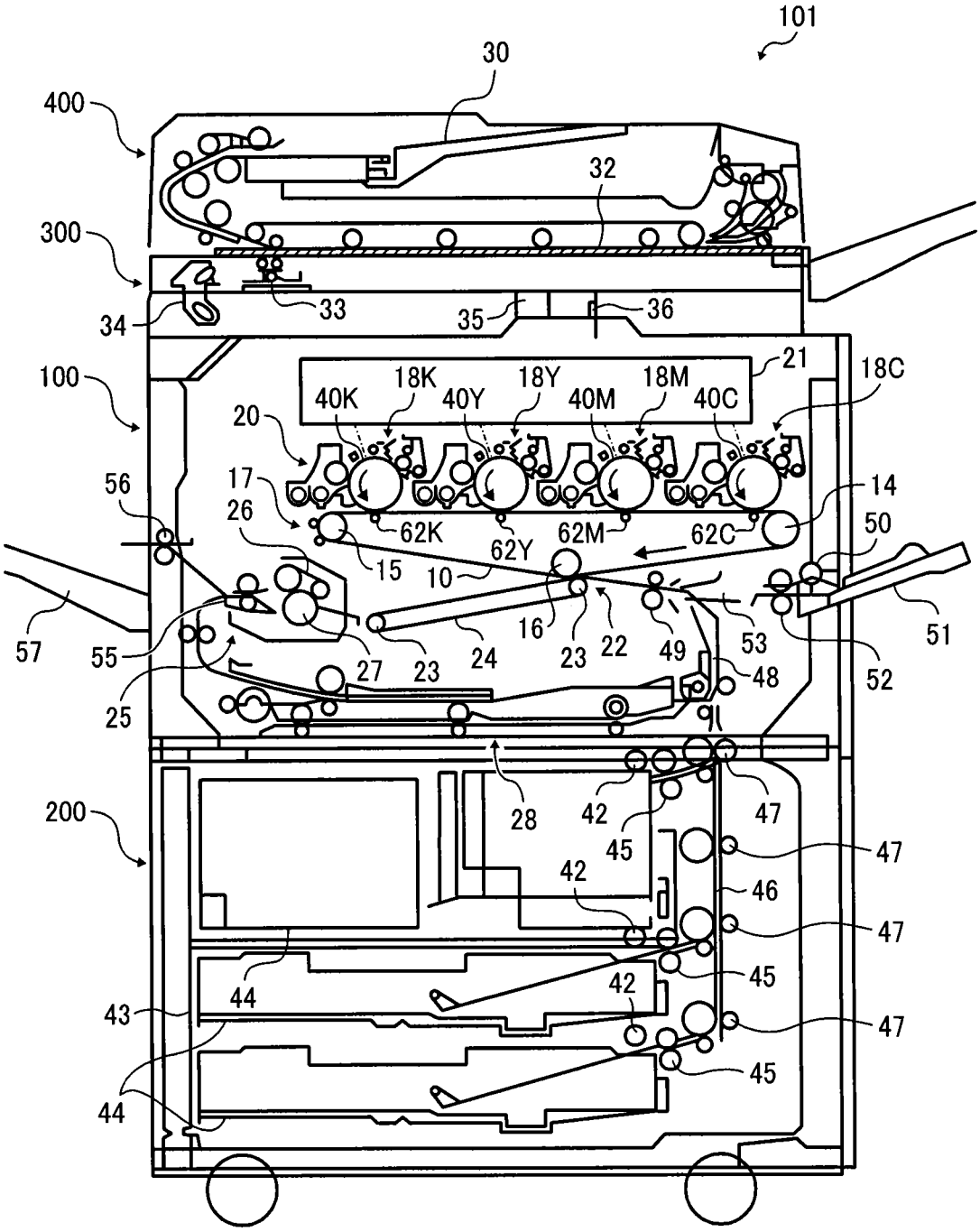
FIG. 1 is a schematic configuration diagram illustrating an example of a copier maintained by an image forming apparatus maintenance system according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, description will be given of an image forming apparatus maintenance system according to an embodiment of the present invention, which includes multiple electrophotographic copiers (hereinafter simply referred to as the copiers) serving as image forming apparatuses and a management apparatus that performs maintenance and management of the image forming apparatuses.

Description will first be given of a fundamental configuration of an example of the copiers in the image forming apparatus maintenance system according to the present embodiment. FIG. 1 is a schematic configuration diagram illustrating an example of a copier 101 maintained by the image forming apparatus maintenance system according to the present embodiment. The copier 101 includes a printer unit 100 including a later-described image forming unit, a sheet feeding unit 200, a scanner unit 300, and a document feeding unit 400. The scanner unit 300 is installed on the printer unit 100, and the document feeding unit 400 is installed on the scanner unit 300. The scanner unit 300 includes a contact glass 32, a first carriage 33, a second carriage 34, an imaging lens 35, and a reading sensor 36. The document feeding unit 400 includes an automatic document feeder (ADF) including a document table 30.

The sheet feeding unit 200 includes an automatic sheet feeding unit provided under the printer unit 100, and a manual sheet feeding unit provided to a side surface of the printer unit 100. In the automatic sheet feeding unit including a sheet bank 43 including multiple sheet feeding cassettes 44, sheet feed rollers 42, separation roller pairs 45, and feed rollers 47, a transfer sheet serving as a recording medium is fed from one of the sheet feeding cassettes 44 by the corresponding sheet feed roller 42, separated from other transfer sheets and fed to a sheet feed path 46 by the corresponding separation roller pair 45, and fed to a sheet feed path 48 of the printer unit 100 by the corresponding feed roller 47. In the manual sheet feeding unit including a sheet feed roller 50, a manual sheet feeding tray 51, and a separation roller pair 52, a transfer sheet is fed from the manual sheet feeding tray 51 by the sheet feed roller 50, and separated from other transfer sheets and fed to a manual sheet feed path 53 by the separation roller pair 52.

The printer unit 100 includes an exposure device 21 serving as an electrostatic latent image forming device, a tandem unit 20 including four process units 18K, 18Y, 18M, and 18C respectively including four photoconductors 40K, 40Y, 40M, and 40C, primary transfer rollers 62K, 62Y, 62M, and 62C, a belt unit including an intermediate transfer belt 10 and support rollers 14, 15, and 16, a belt cleaning device 17, a secondary transfer device 22 including two support rollers 23 and a secondary transfer belt 24, a fixing device 25 including a heating belt 26 and a pressure roller 27, a switching member 55, a transfer sheet reversing device 28, a sheet feed path 48, a registration roller pair 49, a discharge roller pair 56, and a sheet discharging tray 57. The printer unit 100 further includes a sheet discharging device and a toner supply device, which are not illustrated. Herein, the suffixes K, Y, M, and C following reference numerals indicate that components designated thereby correspond to black, yellow, magenta, and cyan colors, respectively.

In the printer unit 100, the registration roller pair 49 is disposed near an end of the sheet feed path 48 to receive the transfer sheet fed from one of the sheet feeding cassettes 44 and the manual sheet feeding tray 51, and feed the transfer sheet with predetermined timing to a secondary transfer nip formed between the secondary transfer device 22 and the intermediate transfer belt 10 serving as an intermediate transfer member.

Figure 7:
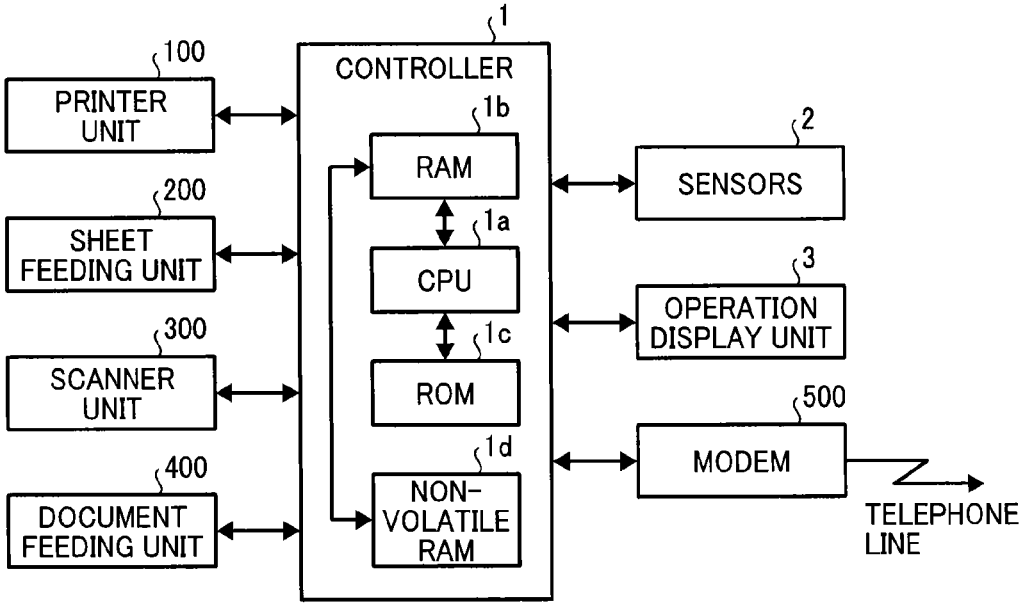
FIG. 7 is a block diagram illustrating a control system of the copier.

In the scanner unit 300, image information of a document placed on the contact glass 32 is read by the reading sensor 36, and is transmitted to a controller 1 (see FIG. 7). On the basis of the image information received from the scanner unit 300, the controller 1 controls components provided in the exposure device 21 of the printer unit 100, such as lasers and light-emitting diodes (LEDs), to direct beams of laser light L (see FIG. 3) onto the four drum-shaped photoconductors 40K, 40Y, 40M, and 40C serving as latent image carriers. Respective outer circumferential surfaces of the photoconductors 40K, 40Y, 40M, and 40C are irradiated with the beams of laser light L to form thereon electrostatic latent images. The latent images are developed through a predetermined development process to form visible toner images.

To make a copy of a color image, an operator places a document on the document table 30 of the document feeding unit 400. Alternatively, the operator opens the document feeding unit 400 to place the document on the contact glass 32 of the scanner unit 300, closes the document feeding unit 400 to hold the document, and presses a start switch. If the document is placed on the document feeding unit 400, the document is fed onto the contact glass 32, and the scanner unit 300 starts to be driven. If the document is placed on the contact glass 32, the scanner unit 300 immediately starts to be driven. Then, the first carriage 33 and the second carriage 34 move, and light emitted from a light source of the first carriage 33 is reflected by a surface of the document and travels to the second carriage 34. The light is then reflected by mirrors of the second carriage 34 and reaches the reading sensor 36 through the imaging lens 35 to be read as image information.

After the image information is thus read, one of the support rollers 14, 15, and 16 in the printer unit 100 is driven to rotate by a drive motor. Thereby, the intermediate transfer belt 10 stretched around the support rollers 14, 15, and 16 is rotated to rotate the remaining two of the support rollers 14, 15, and 16. Then, the above-described laser writing process and a later-described development process are performed to form monochromatic toner images of the black, yellow, magenta, and cyan colors (hereinafter referred to as the K, Y, M, and C colors) on the rotating photoconductors 40K, 40Y, 40M, and 40C, respectively. In respective primary transfer nips for the K, Y, M, and C colors, in which the photoconductors 40K, 40Y, 40M, and 40C come into contact with the intermediate transfer belt 10, the monochromatic toner images are sequentially superimposed and electrostatically transferred (i.e., primary-transferred) onto the intermediate transfer belt 10 to form four-color superimposed toner images.

Meanwhile, to feed a transfer sheet having a size according to the image information, one of the three sheet feed rollers 42 in the sheet feeding unit 200 is driven to guide the transfer sheet to the sheet feed path 48 of the printer unit 100. The transfer sheet fed to the sheet feed path 48 is nipped by the registration roller pair 49 to be temporarily stopped. Thereafter, the transfer sheet is fed with appropriate timing to the secondary transfer nip corresponding to an area of contact between the intermediate transfer belt 10 and one of the support rollers 23 (i.e., the support roller 23 on the right side in FIG. 1) of the secondary transfer device 22 serving as a secondary transfer roller. Thereby, the transfer sheet and the four-color superimposed toner images on the intermediate transfer belt 10 enter the secondary transfer nip in synchronization, and come into close contact with each other. Then, the four-color superimposed toner images are secondary-transferred onto the transfer sheet by nip pressure and a transfer electric field generated in the secondary transfer nip, thereby forming a full-color image with the white color of the transfer sheet.

With the rotation of the secondary transfer belt 24 of the secondary transfer device 22, the transfer sheet passes the secondary transfer nip and is fed to the fixing device 25. In the fixing device 25, the full-color image is fixed on the transfer sheet with pressure and heat applied by the pressure roller 27 and the heating belt 26, respectively. The transfer sheet is then discharged via the discharge roller pair 56 onto the sheet discharging tray 57 provided to a side surface of the printer unit 100.

Figure 2:
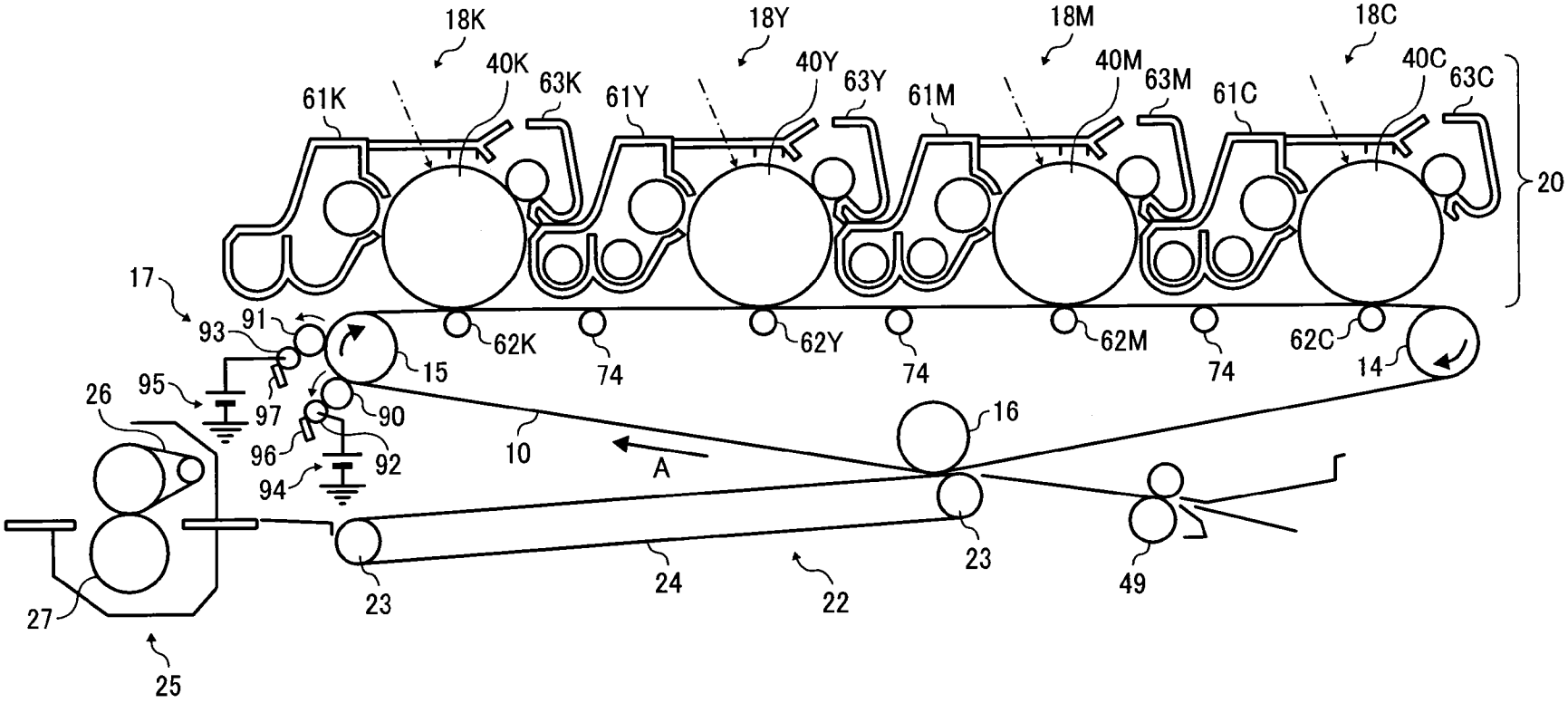
FIG. 2 is an enlarged configuration diagram illustrating a printer unit of the copier.

FIG. 2 is an enlarged configuration diagram illustrating the printer unit 100. As described above, the printer unit 100 includes the belt unit including the intermediate transfer belt 10 and the support rollers 14, 15, and 16, the four process units 18K, 18Y, 18M, and 18C for forming the toner images of the respective colors, the secondary transfer device 22, the belt cleaning device 17, and the fixing device 25.

In the belt unit, the intermediate transfer belt 10 stretched around the support rollers 14, 15, and 16 is rotated while in contact with the photoconductors 40K, 40Y, 40M, and 40C. In the primary transfer nips for the K, Y, M, and C colors, in which the photoconductors 40K, 40Y, 40M, and 40C come into contact with the intermediate transfer belt 10, the primary transfer rollers 62K, 62Y, 62M, and 62C press the intermediate transfer belt 10 against the photoconductors 40K, 40Y, 40M, and 40C from the inner circumferential surface side of the intermediate transfer belt 10. Each of the primary transfer rollers 62K, 62Y, 62M, and 62C is supplied with a primary transfer bias by a power supply. In the primary transfer nips for the K, Y, M, and C colors, therefore, primary transfer electric fields are generated which electrostatically move the toner images on the photoconductors 40K, 40Y, 40M, and 40C toward the intermediate transfer belt 10. Between the primary transfer rollers 62K, 62Y, 62M, and 62C, conductive rollers 74 are provided to be in contact with the inner circumferential surface of the intermediate transfer belt 10. The conductive rollers 74 prevent the primary transfer bias supplied to the primary transfer rollers 62K, 62Y, 62M, and 62C from flowing into the adjacent process units 18K, 18Y, 18M, and 18C via a medium-resistance base layer provided on the inner circumferential surface side of the intermediate transfer belt 10.

Each of the process units 18K, 18Y, 18M, and 18C serves as one unit which includes the corresponding one of the photoconductors 40K, 40Y, 40M, and 40C and some other devices supported by a common support member, and which is attachable to and detachable from the printer unit 100. For example, the process unit 18K for the black color includes, as well as the photoconductor 40K, a development device 61K and a photoconductor cleaning device 63K illustrated in FIG. 2 and a discharging device 64 and a charging device 60 not illustrated in FIG. 2 but illustrated in an enlarged view of FIG. 3. The development device 61K develops the electrostatic latent image formed on the outer circumferential surface of the photoconductor 40K to form a black toner image. The photoconductor cleaning device 63K cleans off post-transfer residual toner adhering to the outer circumferential surface of the photoconductor 40K having passed the primary transfer nip. The discharging device 64 discharges the cleaned outer circumferential surface of the photoconductor 40K. The charging device 60 uniformly charges the discharged outer circumferential surface of the photoconductor 40K. The process units 18Y, 18M, and 18C for the other colors are substantially similar in configuration to the process unit 18K except for the difference in color of toner contained therein. The present copier 101 employs a so-called tandem configuration in which the four process units 18K, 18Y, 18M, and 18C are aligned in the rotation direction of the intermediate transfer belt 10 to face the intermediate transfer belt 10.

Figure 3:
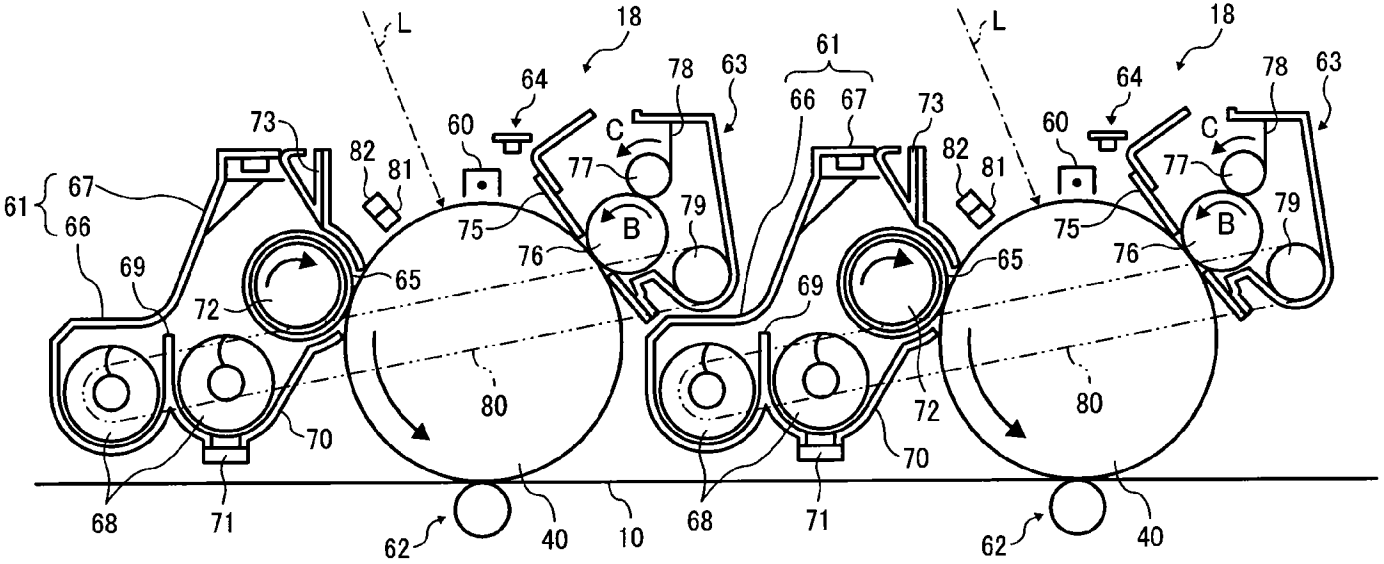
FIG. 3 is a partial enlarged view illustrating a part of a tandem unit of the printer unit.

FIG. 3 is a partial enlarged view illustrating a part of the tandem unit 20 including the four process units 18K, 18Y, 18M, and 18C. The four process units 18K, 18Y, 18M, and 18C are substantially similar in configuration except for the difference in color of toner contained therein, as described above. In FIG. 3, therefore, the suffixes K, Y, M, and C following reference numerals are omitted. As illustrated in FIG. 3, a process unit 18 includes a photoconductor 40 surrounded by a charging device 60, a development device 61, a primary transfer roller 62 serving as a primary transfer device, a photoconductor cleaning device 63, a discharging device 64, a photoconductor potential sensor 81, and a thermo-hygro sensor 82.

The drum-shaped photoconductor 40 is, for example, an aluminum pipe coated with an organic photosensitive material to form a photosensitive layer. Alternatively, the photoconductor 40 may be an endless belt. The charging device 60 is a non-contact charging device which charges the photoconductor 40 in a non-contact manner. Alternatively, the charging device 60 may be configured as a contact charging device including a charging roller supplied with a charging bias and rotated while in contact with the photoconductor 40, so as to suppress the generation of discharge products.

The development device 61 develops the latent image with a two-component developer including magnetic carrier and non-magnetic toner. The development device 61 includes a mixing section 66 and a development section 67. The mixing section 66 mixes and transports the two-component developer contained therein to supply the two-component developer to a development sleeve 65. The development section 67 transfers the toner of the two-component developer adhering to the development sleeve 65 onto the photoconductor 40.

The mixing section 66 is located lower than the development section 67, and houses two screws 68 disposed to be parallel to each other, a dividing plate 69 provided between the screws 68, and a toner concentration sensor 71 provided to a bottom surface of a development case 70. The development section 67 houses the development sleeve 65 facing the photoconductor 40 through an opening formed in the development case 70, a magnet roller 72 non-rotatably provided inside the development sleeve 65, and a doctor blade 73 having a leading end located close to the development sleeve 65.

A minimum gap between the doctor blade 73 and the development sleeve 65 is set to approximately 500 μm. The development sleeve 65 is a rotatable non-magnetic sleeve member. The magnet roller 72 is configured not to rotate together with the development sleeve 65, and has five magnetic poles N1, S1, N2, S2, and S3, for example, along the rotation direction of the development sleeve 65 from a position corresponding to the doctor blade 73. At a predetermined position in the rotation direction, magnetic force of the magnetic poles N1, S1, N2, S2, and S3 acts on the two-component developer carried on the development sleeve 65. Thereby, the two-component developer transported from the mixing section 66 is attracted to and carried on an outer circumferential surface of the development sleeve 65, thereby forming a magnetic brush around the outer circumferential surface of the development sleeve 65 along lines of magnetic force.

With the rotation of the development sleeve 65, the magnetic brush passes a position facing the doctor blade 73, and thereby is regulated into an appropriate layer thickness. The magnetic brush is then moved to a development area facing the photoconductor 40, and is transferred onto the electrostatic latent image on the photoconductor 40 by the potential difference between a development bias supplied to the development sleeve 65 and the electrostatic latent image, thereby contributing to the development process. Then, with the rotation of the development sleeve 65, the magnetic brush returns to the development section 67, separates from the outer circumferential surface of the development sleeve 65 owing to a repulsive magnetic field between the magnetic poles N1, S1, N2, S2, and S3 of the magnetic roller 72, and returns to the mixing section 66. In the mixing section 66, an appropriate amount of toner is supplied to the two-component developer on the basis of the detection result of the toner concentration sensor 71. In the development device 61, the two-component developer may be replaced by a one-component developer not including magnetic carrier.

The photoconductor cleaning device 63 includes a cleaning blade 75, a fur brush 76, an electric field roller 77 made of metal, a scraper 78, and a collecting screw 79. In the present embodiment, the photoconductor cleaning device 63 employs a system in which the cleaning blade 75 made of polyurethane rubber is pressed against the photoconductor 40. Alternatively, the photoconductor cleaning device 63 may employ a different system. To improve cleaning performance, the photoconductor cleaning device 63 of the present embodiment employs the contact-type conductive fur brush 76 having an outer circumferential surface in contact with the photoconductor 40 and rotatable in the direction of arrow B in FIG. 3. Further, the electric field roller 77 for supplying a bias to the fur brush 76 is disposed to be rotatable in the direction of arrow C in FIG. 3, and a leading end of the scraper 78 is pressed against the electric field roller 77. The toner removed from the electric field roller 77 by the scraper 78 falls on and is collected by the collecting screw 79.

In the thus-configured photoconductor cleaning device 63, the residual toner remaining on the photoconductor 40 is removed by the fur brush 76 rotating in the counter direction against the photoconductor 40. The toner adhering to the fur brush 76 is removed by the electric field roller 77 supplied with a bias and rotating while in contact with the fur brush 76 in the counter direction. The toner adhering to the electric field roller 77 is cleaned off by the scraper 78. The toner collected by the photoconductor cleaning device 63 is moved to a corner of the photoconductor cleaning device 63 by the collecting screw 79, and is returned to the development device 61 by a toner recycling device 80 to be recycled.

The discharging device 64 includes, for example, a discharging lamp to irradiate the outer circumferential surface of the photoconductor 40 with light and thereby discharge the surface potential of the photoconductor 40. The thus-discharged outer circumferential surface of the photoconductor 40 is uniformly charged by the charging device 60, and then is subjected to the optical writing process.

The photoconductor potential sensor 81 is disposed near the outer circumferential surface of the photoconductor 40 without contacting the photoconductor 40, and detects the surface potential of the photoconductor 40. Any common potential sensor may be used as the photoconductor potential sensor 81.

The thermo-hygro sensor 82 is disposed near the photoconductor 40, and detects the temperature and humidity near the photoconductor 40. It is preferable that multiple thermo-hygro sensors 82 are provided in the copier 101. However, although the humidity inside the copier 101 fluctuates slightly, it is substantially constant. Therefore, only one thermo-hygro sensor 82 may be provided in the copier 101 to reduce costs.

As illustrated in FIG. 2, the secondary transfer device 22 is provided under the belt unit. In the secondary transfer device 22, the secondary transfer belt 24 is stretched and rotated between the two support rollers 23. One of the support rollers 23 (i.e., the support roller 23 on the right side in FIG. 2) serving as the secondary transfer roller is supplied with a secondary transfer bias by a power supply, and the intermediate transfer belt 10 and the secondary transfer belt 24 are nipped between the support roller 23 and the support roller 16 of the belt unit. Thereby, the secondary transfer nip is formed in which the intermediate transfer belt 10 and the secondary transfer belt 24 move in the same direction while in contact with each other. Due to a secondary transfer electric filed and nip pressure, the four-color superimposed toner images on the intermediate transfer belt 10 are secondary-transferred at one time onto the transfer sheet fed to the secondary transfer nip from the registration roller pair 49, thereby forming a full-color image. The transfer sheet passes the secondary transfer nip, and separates from the intermediate transfer belt 10. Then, with the rotation of the secondary transfer belt 24, the transfer sheet carried on the outer circumferential surface of the secondary transfer belt 24 is fed to the fixing device 25. The support roller 23 serving as the secondary transfer roller may be replaced by, for example, a transfer charger to perform the secondary transfer.

Meanwhile, the outer circumferential surface of the intermediate transfer belt 10 passes the secondary transfer nip, and reaches a position at which the intermediate transfer belt 10 is supported by the support roller 15. At this position, the intermediate transfer belt 10 is nipped between the belt cleaning device 17 in contact with the outer circumferential surface (i.e., outer loop surface) of the intermediate transfer belt 10 and the support roller 15 in contact with the inner circumferential surface of the intermediate transfer belt 10, and post-transfer residual toner adhering to the outer circumferential surface of the intermediate transfer belt 10 is removed by the belt cleaning device 17. Thereafter, the intermediate transfer belt 10 sequentially enters the primary transfer nips for the K, Y, M, and C colors, and the next toner images of the four colors are superimposed on the intermediate transfer belt 10.

The belt cleaning device 17 includes two fur brushes 90 and 91, metal rollers 92 and 93, power supplies 94 and 95, and blades 96 and 97. The fur brushes 90 and 91 rotate while in contact with the intermediate transfer belt 10 in the counter direction against the implanting direction of bristles of the fur brushes 90 and 91, to thereby mechanically scrape the post-transfer residual toner off the intermediate transfer belt 10. Further, each of the fur brushes 90 and 91 is supplied with a cleaning bias by a power supply to electrostatically attract and collect the scraped post-transfer residual toner.

The metal rollers 92 and 93 are in contact with the fur brushes 90 and 91, respectively, and rotate in a direction the same as or opposite to the rotation direction of the fur brushes 90 and 91. The metal roller 92 located upstream of the metal roller 93 in the rotation direction of the intermediate transfer belt 10 is supplied with a voltage of negative polarity by the power supply 94. The metal roller 93 located downstream of the metal roller 92 in the rotation direction of the intermediate transfer belt 10 is supplied with a voltage of positive polarity by the power supply 95. The metal rollers 92 and 93 are in contact with a leading end of the blade 96 and a leading end of the blade 97, respectively. In this configuration, the upstream fur brush 90 first cleans the outer circumferential surface of the intermediate transfer belt 10 with the rotation of the intermediate transfer belt 10 in the direction of arrow A in FIG. 2. In this process, the fur brush 90 is supplied with a voltage of approximately −400 V, while the metal roller 92 is supplied with a voltage of approximately −700 V, for example. Thereby, toner of positive polarity on the intermediate transfer belt 10 is electrostatically transferred to the fur brush 90. Then, the toner is further transferred to the metal roller 92 from the fur brush 90 by the potential difference therebetween, and is scraped off by the blade 96.

Some of the toner on the intermediate transfer belt 10 is thus removed by the fur brush 90, but some of the toner still remains on the intermediate transfer belt 10. Such toner is negatively charged by the bias of negative polarity supplied to the fur brush 90. Then, the downstream fur brush 91 supplied with the bias of positive polarity performs cleaning to remove the toner. The removed toner is transferred from the fur brush 91 to the metal roller 93 by the potential difference therebetween, and is scraped off by the blade 97. The toner scraped off by the blades 96 and 97 is collected in a tank. After the cleaning by the fur brush 91, most of the toner on the intermediate transfer belt 10 is removed. However, a slight amount of the toner still remains on the intermediate transfer belt 10. Such toner still remaining on the intermediate transfer belt 10 is charged to the positive polarity by the bias of positive polarity supplied to the fur brush 91, as described above. The toner is then transferred to the photoconductors 40K, 40Y, 40M, and 40C by the transfer electric fields generated in the respective primary transfer nips, and is collected by the photoconductor cleaning devices 63K, 63Y, 63M, and 63C.

Returning to FIG. 1, the registration roller pair 49 is commonly grounded but may be supplied with a bias to remove paper dust arising from the transfer sheet. Further, the transfer sheet reversing device 28 extending parallel to the tandem unit 20 is provided below the secondary transfer device 22 and the fixing device 25. With this configuration, the transfer sheet having one surface subjected to the image fixing process is guided toward the transfer sheet reversing device 28 by the switching member 55, reversed by the transfer sheet reversing device 28, and again fed to the secondary transfer nip. Then, the other surface of the transfer sheet is subjected to the secondary transfer process and the image fixing process, and is discharged onto the sheet discharging tray 57.

In the thus-configured copier 101, components such as the process units 18K, 18Y, 18M, and 18C, the secondary transfer device 22, and the exposure device 21 form an image forming unit which forms an image on the transfer sheet serving as a recording medium.

Figure 5:
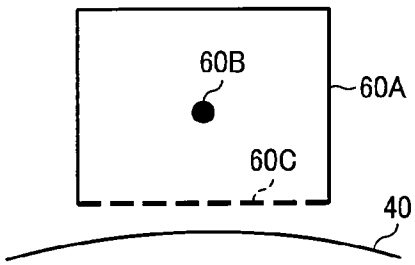
FIG. 5 is an explanatory diagram illustrating a schematic configuration of a scorotron corona charger as another example of the charging device of the printer unit.
Figure 4:
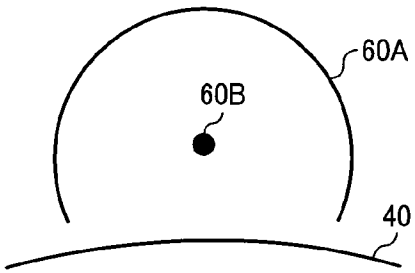
FIG. 4 is an explanatory diagram illustrating a schematic configuration of a corotron corona charger as an example of a charging device of the printer unit.

FIG. 4 is an explanatory diagram illustrating a schematic configuration of a corotron corona charger as an example of the charging device 60 of the present embodiment. FIG. 5 is an explanatory diagram illustrating a schematic configuration of a scorotron corona charger as another example of the charging device 60 of the present embodiment.

Preferably, the charging device 60 of the present embodiment may employ a corona charger. Corona discharge used in the corona charger is a phenomenon in which, when a relatively high voltage is supplied to a micro-diameter wire disposed on a metal electrode and is gradually increased, purplish light is emitted near the wire before spark discharge. With this discharge phenomenon, the air is continuously ionized, and the ions move along an electric field generated between the wire and the photoconductor 40. If a relatively high voltage is supplied between electrodes, a slight amount of positive and negative ions and electrons present in the air is increased in moving speed by a relatively high electric field, and moves between the electrodes. When the kinetic energy of the electrons reaches or exceeds the ionization energy, an ionization amplification effect is caused which ejects electrons during the collision with the air. This phenomenon exponentially produces electrons and ionizes the air, and is called an electron avalanche phenomenon. Ions are also produced by, for example, impact ionization of positive ions impacting gas molecules or by positive ions impacting an electrode and ejecting electrons from the electrode. In an area near the wire, there is a relatively high electric field, and thus the electron avalanche phenomenon is more likely to occur. The electric field weakens with distance from the wire, and the electron avalanche stops during the separation from the wire. Thus, the light emission due to the discharge is limited to the area near the wire.

To improve discharge stability, the corotron corona charger illustrated in FIG. 4 is configured to shield a wire 60B with a cylindrical metal shield case 60A. Alternatively, the metal shield case A may have a rectangular shape. The metal shield case 60A is provided with an opening facing the photoconductor 40. Through the opening, ions having the same polarity as that of the wire 60B are discharged to charge the outer circumferential surface of the photoconductor 40. The wire 60B is usually supplied with a direct-current voltage. It is difficult for the corotron corona charger to maintain a stable charge potential on the outer circumferential surface of the photoconductor 40.

The scorotron corona charger illustrated in FIG. 5 is capable of maintaining a stable charge potential on the outer circumferential surface of the photoconductor 40, and controlling the charge potential as desired. The scorotron corona charger is configured to include a corotron corona charger provided with a grid (i.e., screen electrode) 60C. The grid 60C with a pitch of a few millimeters is disposed at a position separated from the photoconductor 40 by approximately 1 mm to approximately 2 mm. The grid 60C is made of a material such as stainless steel or tungsten. A voltage supplied to the grid 60C is controlled to control the charge potential as desired.

The gases generated by the corona discharge include ozone gas and nitrogen oxide gas. If such discharge products adhere to the outer circumferential surface of the photoconductor 40, the photosensitive property of the photoconductor 40 is adversely affected, causing a blurred image or a tailing image, for example. An abnormal image, such as a blurred image or a tailing image, due to discharge products adhering to the outer circumferential surface of the photoconductor 40 particularly occurs when the image forming operation is performed after the copier 101 is placed at rest in a high-humidity environment subsequently to the last image forming operation using the charging device 60. The abnormal image is gradually reduced by continuously performing the image forming operation. This is considered to be because damp discharge products on the photoconductor 40 are scraped off by, for example, the cleaning blade 75, the fur brush 76, and the developer in contact with the photoconductor 40.

Figure 6:
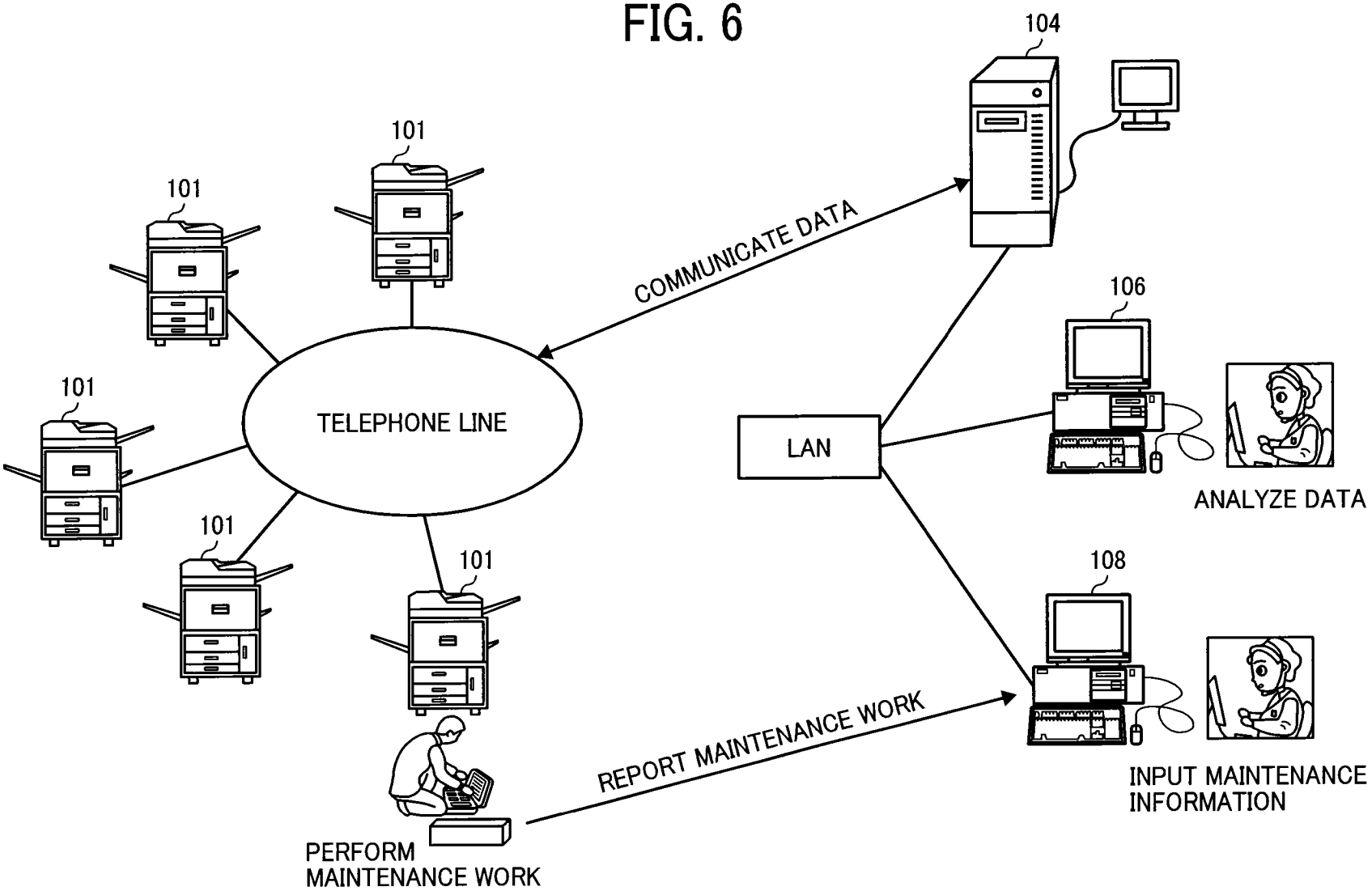
FIG. 6 is an explanatory diagram illustrating a schematic configuration of the image forming apparatus maintenance system.

FIG. 6 is an explanatory diagram illustrating a schematic configuration of the image forming apparatus maintenance system of the present embodiment. The image forming apparatus maintenance system of the present embodiment includes multiple copiers 101 and a management apparatus 104. The copiers 101 are installed at locations of different users, and are connected to the management apparatus 104 via a communication network, such as a telephone line. Further, the management apparatus 104 has an analysis computer 106 and a maintenance information management computer 108 connected thereto via a local area network (LAN) to be communicable with one another. The management apparatus 104, the analysis computer 106, and the maintenance information management computer 108 are installed in a remote monitoring facility of a maintenance and management service provider. Each of the management apparatus 104, the analysis computer 106, and the maintenance information management computer 108 is implemented as a common personal computer.

FIG. 7 is a block diagram illustrating a control system of the copier 101 of the present embodiment. The copier 101 includes a controller 1 serving as a control device which performs overall control of the copier 101. The controller 1 includes a central processing unit (CPU) 1*a* serving as an arithmetic processor and an information storage unit. The information storage unit includes, for example, a random access memory (RAM), a read-only memory (ROM), and a hard disk drive (HDD) for storing data. In the present embodiment, the formation storage unit includes, for example, a ROM 1*c*, a RAM 1*b*, and a nonvolatile RAM 1*d*. The ROM 1*c* stores, for example, an operating system (OS) of the copier 101, a variety of control programs necessary for copy, facsimile, and print functions, and initial setting values of a printer page description language (PDL) processing system and the copier 101. The RAM 1*b* serves as a working memory.

In the present embodiment, sensors 2, such as the photoconductor potential sensor 81 and the thermo-hygro sensor 82, detect a variety of status information concerning the state inside the copier 101, including prediction-use information useful for predicting a photoconductor surface contamination level (i.e., latent image carrier surface contamination level). The nonvolatile RAM 1*d* of the controller 1 stores the variety of status information including characteristic values useful for the prediction. Each of the characteristic values useful for the prediction is stored in association with the date and time of sampling. For example, if the temperature near the photoconductor 40 detected by the thermo-hygro sensor 82 at 12:30 on Jan. 1, 2011 is 25 degrees Celsius, the information of the temperature is stored as "25, 12:30/01/01/2011."

To allow the management apparatus 104 to observe changes over time of the characteristic values, the characteristic values concerning the prediction-use information useful for predicting the photoconductor surface contamination level are sampled at predetermined intervals. In the present embodiment, the interval is every 1,000 copies. Further, in the present embodiment, the length of operation (i.e., operation time) of a photoconductor surface contamination reduction operation (i.e., discharge product removal operation) is calculated and adjustable, as described later. The photoconductor surface contamination reduction operation is performed before the start of the image forming operation following a predetermined specified rest time. Therefore, the sampling is also performed before the start of the image forming operation following the specified rest time.

In the image forming apparatus maintenance system of the present embodiment, the variety of characteristic values stored in the nonvolatile RAM 1*d* of each of the copiers 101 are transmitted to the management apparatus 104 at a predetermined time by a modem 500 via the communication network such as a telephone line. Although the time of transmitting the characteristic values is set as appropriate, at least characteristic values concerning the prediction-use information useful for predicting the photoconductor surface contamination level are transmitted to the management apparatus 104 at a predetermined time immediately after the sampling. The characteristic values useful for the prediction received by the management apparatus 104 are stored in a hard disk of the management apparatus 104, as classified by the copiers 101 (i.e., by users).

Figure 8:
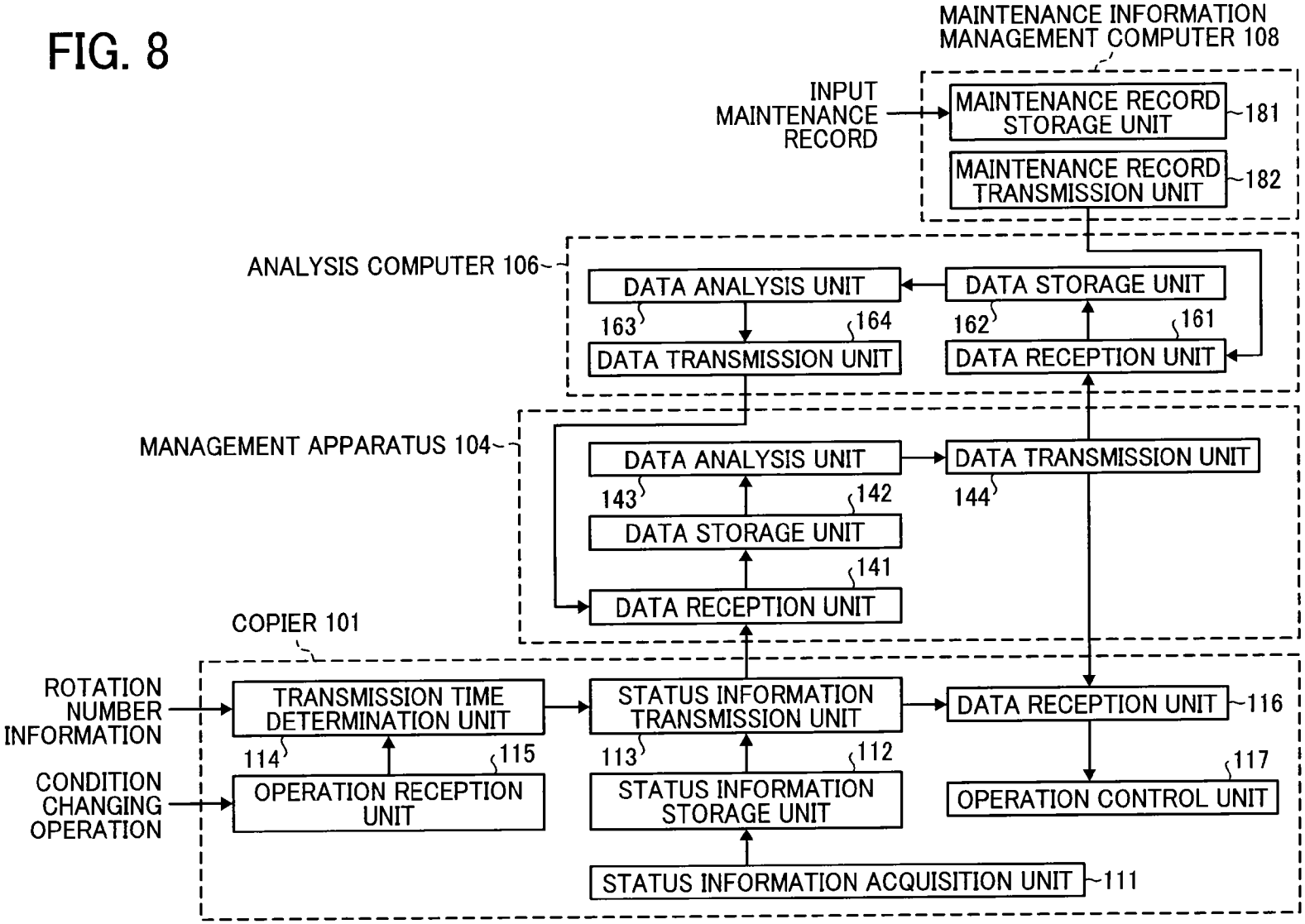
FIG. 8 is a functional block diagram illustrating main configurations of the image forming apparatus maintenance system relating to a process of predicting a photoconductor surface contamination level.

FIG. 8 is a functional block diagram illustrating main configurations of the present image forming apparatus maintenance system relating to the process of predicting the photoconductor surface contamination level. In the present embodiment, respective functions are distributed to the copier 101, the management apparatus 104, the analysis computer 106, and the maintenance information management computer 108, as illustrated in FIG. 8. Alternatively, the distribution of the functions may be otherwise set as appropriate.

As illustrated in FIG. 8, the present copier 101 includes, for example, a status information acquisition unit 111, a status information storage unit 112, a status information transmission unit 113, a transmission time determination unit 114, an operation reception unit 115, a data reception unit 116, and an operation control unit 117.

The status information acquisition unit 111, the status information storage unit 112, and the status information transmission unit 113 together form a prediction-use information acquisition and transmission device. The status information acquisition unit 111 includes, for example, the sensors 2 which acquire the variety of status information (i.e., characteristic values) concerning the state inside the copier 101. The status information storage unit 112 includes, for example, the nonvolatile RAM 1*d* which stores the status information acquired by the status information acquisition unit 111. The status information transmission unit 113 transmits the status information (i.e., characteristic values) stored by the status information storage unit 112 to the management apparatus 104.

The transmission time determination unit 114 determines, on the basis of information concerning the cumulative rotation number of the photoconductor 40, for example, the time at which the status information transmission unit 113 transmits the status information (i.e., characteristic values) to the management apparatus 104. The operation reception unit 115 includes, for example, an operation display unit 3 (see FIG. 7) of the copier 101. The operation reception unit 115 receives an input of a condition changing operation by, for example, an operator, and changes a transmission time determination condition of the transmission time determination unit 114 in accordance with the operation.

The data reception unit 116 and the operation control unit 117 together form a contamination reduction device. The data reception unit 116 includes, for example, the modem 500 for receiving an instruction to execute the photoconductor surface contamination reduction operation transmitted from the management apparatus 104. On the basis of the execution instruction received by the data reception unit 116, the operation control unit 117 controls the respective units to execute the photoconductor surface contamination reduction operation.

Further, as illustrated in FIG. 8, the management apparatus 104 includes, for example, a data reception unit 141, a data storage unit 142, a data analysis unit 143, and a data transmission unit 144. The data reception unit 141 functions as a prediction-use information reception device, and receives the status information (i.e., characteristic values) transmitted from the copier 101 via the communication network such as a telephone line. The data reception unit 141 also receives information transmitted from the analysis computer 106 and the maintenance information management computer 108 via the LAN. The data storage unit 142 includes, for example, the hard disk for storing the information received by the data reception nit 141 and a variety of analysis programs.

The data analysis unit 143 functions as a latent image carrier surface contamination level prediction device, and executes the analysis programs stored in the data storage unit 142. With the status information (i.e., characteristic values) stored in the data storage unit 142, the data analysis unit 143 performs a prediction process of calculating (i.e., predicting) a physical quantity, a feature quantity, and the photoconductor surface contamination level (i.e., F value), which will be described in detail later. Further, the data analysis unit 143 forms an execution instruction transmission device together with the data transmission unit 144. The data analysis unit 143 executes the analysis programs, and calculates, with the F value calculated by the prediction process, the length of operation (i.e., operation time) of a preliminary photoconductor rotation operation (i.e., photoconductor surface contamination reduction operation) for removing the discharge products adhering to the outer circumferential surface of the photoconductor 40. In accordance with the result of processing by the data analysis unit 143, the data transmission unit 144 transmits the instruction to execute the photoconductor surface contamination reduction operation to the corresponding copier 101 via the communication network such as a telephone line.

Further, as illustrated in FIG. 8, the maintenance information management computer 108 includes, for example, a maintenance record storage unit 181 and a maintenance record transmission unit 182. After maintenance work of the copier 101, a maintenance technician having performed the maintenance work manually prepares a maintenance report describing the contents of the maintenance work. The thus-prepared maintenance report is sent to a maintenance information administrator. The maintenance information administrator manually enters the described contents of the maintenance report into the maintenance information management computer 108. Maintenance information corresponding to the thus-input contents of the maintenance work is stored in the maintenance record storage unit 181. In response to a request from the analysis computer 106, the maintenance information stored in the maintenance record storage unit 181 is transmitted to the analysis computer 106 from the maintenance record transmission unit 182 via the LAN.

Further, as illustrated in FIG. 8, the analysis computer 106 serving as a prediction process updating device includes, for example, a data reception unit 161, a data storage unit 162, a data analysis unit 163, and a data transmission unit 164. The data reception unit 161 receives, via the LAN, information transmitted from the management apparatus 104 and information transmitted from the maintenance information management computer 108. The data storage unit 162 includes, for example, a hard disk for storing the information received by the data reception unit 161 and a variety of analysis programs. The data analysis unit 163 functions as a modification device. The data analysis unit 163 reads from the data storage unit 162 the maintenance information corresponding to the time of occurrence of an abnormal image due to the discharge products adhering to the outer circumferential surface of the photoconductor 40, and extracts the status information (i.e., characteristic values) of the copier 101 corresponding to the time of occurrence of the abnormal image. Then, on the basis of a later-described boosting method or Mahlanobis distance using the extracted status information (i.e., characteristic values) of the copier 101, the data analysis unit 163 modifies, for example, calculation algorithms for calculating the photoconductor surface contamination level (i.e., F value), to thereby generate new analysis programs to be executed by the data analysis unit 143 of the management apparatus 104. The data transmission unit 164 transmits the new analysis programs generated by the data analysis unit 163 to the management apparatus 104 via the LAN.

If the new analysis programs are transmitted from the analysis computer 106, the management apparatus 104 of the present embodiment receives the new analysis programs at the data reception unit 141, and rewrites the existing analysis programs stored in the data storage unit 142 to the received new analysis programs. Accordingly, the data analysis unit 143 of the management apparatus 104 thereafter performs the process of predicting the photoconductor surface contamination level (i.e., F value) and the process of calculating the length of operation (i.e., operation time) of the preliminary photoconductor rotation operation (i.e., photoconductor surface contamination reduction operation) in accordance with the new analysis programs.

According to the present embodiment, the analysis programs are thus continuously updated on the basis of the status information of the copiers 101 released on the market. Accordingly, the accuracy of the process of predicting the photoconductor surface contamination level (i.e., F value) and the process of calculating the appropriate operation time of the preliminary photoconductor rotation operation is improved over time.

Description will now be given of the processing performed by the data analysis unit 143 of the management apparatus 104 in the present embodiment. The status information (i.e., characteristic values) sampled in and transmitted from the respective copiers 101 is first received by the data reception unit 141, and then is stored in the data storage unit 142 as classified by the copiers 101. At a predetermined time, such as upon receipt of the status information (i.e., characteristic values) by the data reception unit 141, for example, the data analysis unit 143 performs the process of predicting the photoconductor surface contamination level (i.e., F value) and the process of calculating the operation time of the preliminary photoconductor rotation operation for the copier 101 having transmitted the characteristic values.

Figure 9:
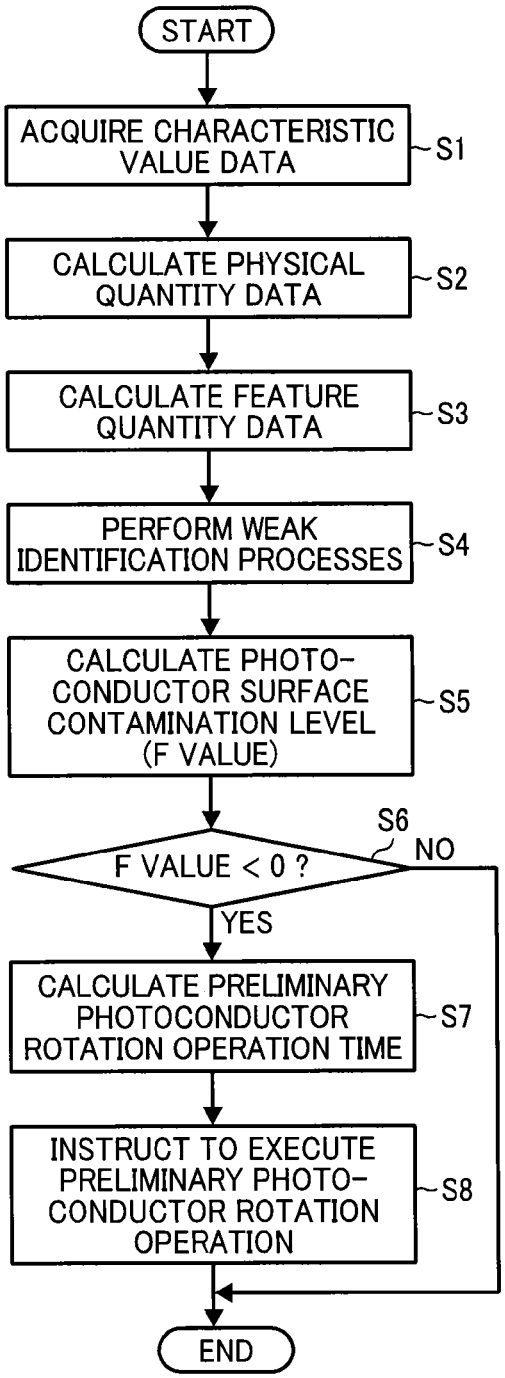
FIG. 9 is a flowchart illustrating processing performed by a data analysis unit of a management apparatus in the image forming apparatus maintenance system.

FIG. 9 is a flowchart illustrating processing performed by the data analysis unit 143 of the management apparatus 104 in the present embodiment. At a predetermined time, such as upon receipt of the status information (i.e., characteristic values) by the data reception unit 141, for example, the data analysis unit 143 acquires from the data storage unit 142 characteristic value data (i.e., prediction-use information) of the copier 101 having transmitted the characteristic values (step S1). Then, with the acquired characteristic value data, the data analysis unit 143 performs a process of calculating physical quantity data (step S2).

The physical quantity data refers to various types of information generated inside the copier 101, and may be raw information generated inside the copier 101 or one or more information items processed from the same type of information. For example, in the case of charge potential data VdHome generated inside the copier 101, the physical quantity data may be the charge potential data VdHome per se or chronologically variable data VdExpnd of the charge potential data VdHome calculated from the following equation (1) using a maximum value max and a minimum value min of the charge potential data VdHome in a predetermined period. In the equation (1), VdHome.max.ref represents the maximum value max of the charge potential data VdHome serving as a reference value, and VdHome.min.ref represents the minimum value min of the charge potential data VdHome serving as a reference value.

$$Vd\text{Expnd}=(Vd\text{Home.max}-Vd\text{Home.min})-(Vd\text{Home.max.ref}-Vd\text{Home.min.ref}) \quad (1)$$

After the physical quantity data is thus calculated, the data analysis unit 143 calculates feature quantity data (step S3). The feature quantity data refers to an index value indicating a characteristic behavior of the physical quantity data useful for predicting the photoconductor surface contamination level. For example, substantial variation among multiple values of the charge potential data VdHome acquired in a predetermined period indicates a state in which an abnormal image, such as a blurred image or a tailing image, due to the generation of the discharge products is likely to occur, i.e., a state in which the outer circumferential surface of the photoconductor 40 has been contaminated. Accordingly, the variation among multiple values of the charge potential data VdHome in a predetermined period, specifically the variance or standard deviation of the multiple values of the charge potential data VdHome may be used as the feature quantity data useful for predicting the photoconductor surface contamination level.

Specifically, upon acquisition of a value of the charge potential data VdHome, the data analysis unit 143 extracts from the data storage unit 142 the latest sixteen values of the charge potential data VdHome including the acquired value of the charge potential data VdHome, calculates the standard deviation of the sixteen values, and stores the calculation result in the data storage unit 142 as the feature quantity data. The feature quantity data is not limited to the variation among multiple values of the physical quantity data or the characteristic value data in a predetermined period. The feature quantity data includes index values calculated from various calculation formulae, such as the mean value, the maximum value, and the regression value of the changes in signal, and indicating a characteristic behavior of the physical quantity data useful for predicting the level of contamination of the outer circumferential surface of the photoconductor 40 due to the discharge products.

After the feature quantity data is thus calculated, the data analysis unit 143 calculates the photoconductor surface contamination level (i.e., F value) from the calculated feature quantity data (steps S4 and S5). In general, it is difficult to highly accurately predict an abnormality occurring in a copier in the near future, particularly an abnormal image caused by the contamination of the outer circumferential surface of a photoconductor due to discharge products, by using only one type of feature quantity data. In the present embodiment, therefore, the photoconductor surface contamination level (i.e., F value), which is an index value indicating the level of contamination of the outer circumferential surface of the photoconductor 40 due to the discharge products, is calculated from multiple types of feature quantity data, and whether or not to perform the photoconductor surface contamination reduction operation of reducing the contamination of the outer circumferential surface of the photoconductor 40 is determined on the basis of the data of the F value.

A sign of an abnormality occurring in the near future may be read by detecting various distinctive and unstable behaviors in a signal which is stable in a normal state. In the present embodiment, therefore, multiple types of appropriate feature quantity data are extracted, and the F value data is calculated from the extracted multiple types of feature quantity data.

Description will now be given of an example of the process of calculating the F value data. The data analysis unit 143 of the management apparatus 104 first performs a process of identifying the respective tendencies of the multiple types of feature quantity data $C_i$ (i is an identifier indicating the type) to be used to calculate the F value. For example, in the tendency identification process of the present embodiment, the feature quantity data $C_i$ is compared with an identification threshold $b_i$ for each of the multiple types of feature quantity data $C_i$. Then, a binarization process is performed which outputs a value 0 indicating the absence of an abnormal tendency if the value of the feature quantity data $C_i$ is smaller than the value of the identification threshold $b_i$, and outputs a value 1 indicating the presence of the abnormal tendency if the value of the feature quantity data $C_i$ is equal to or larger than the value of the identification threshold $b_i$.

Thereafter, the data analysis unit 143 performs a weighted majority operation on the results of the tendency identification process performed on the multiple types of feature quantity data $C_i$. That is, if the result of the tendency identification process is the value 1 indicating the presence of the abnormal tendency, a weight $\alpha_i$ allocated to the corresponding one of the multiple types of feature quantity data $C_i$ is provided with positive polarity (+) as identification polarity $sgn_i$. Meanwhile, if the result of the tendency identification process is the value 0 indicating the absence of the abnormal tendency, the weight $\alpha_i$ is provided with negative polarity (−) as the identification polarity $sgn_i$. Then, the resultant values are added. In the present embodiment, the value calculated by the weighted majority operation is determined as the F value.

The above-described identification threshold $b_i$ and weight $\alpha_i$ used in the present embodiment may be generated by the use of a supervised learning algorithm, i.e., a so-called boosting method. The boosting method is disclosed in, for example, "Information Geometry of Statistical Pattern Identification," MATHEMACIAL SCIENCE, No. 489, March 2004. The method will be summarized as follows. Two types of status information are first prepared: status information (i.e., multiple types of feature quantity data) of a state previously confirmed as a normal state and status information (i.e., multiple types of feature quantity data) of a state confirmed as an abnormality predictive state immediately preceding the occurrence of an abnormality. To obtain the latter type of status information, status information logs are stored during, for example, an endurance test of a device, and an abnormality predictive period corresponding to a state preceding and predictive of an abnormality is estimated. Then, status information (i.e., multiple types of feature quantity data) in the abnormality predictive period is used. In the present embodiment, the history of the multiple types of status information is stored in the copiers 101 released on the market. If the copiers 101 have any abnormality and are subjected to maintenance work, therefore, the status information in the abnormality predictive period corresponding to the state preceding and predictive of the abnormality is collected. Then, the status information (i.e., multiple types of feature quantity data) in the abnormality predictive period is collected from the maintenance information. The status information in the abnormality predictive period is then labeled with a negative value, and the other status information (i.e., normal data) is labeled with a positive value. The learning is iterated 100 times by the boosting method to output identification thresholds $b_1$ to $b_{100}$ and weights $\alpha_1$ to $\alpha_{100}$, and the identification threshold $b_i$ and the weight $\alpha_i$ are determined on the basis of the outputs.

In the present embodiment, with the thus-determined identification threshold $b_i$, the tendency identification process of determining whether the feature quantity data $C_i$ is normal or abnormal is performed on each of the multiple types of feature quantity data $C_i$, as described above. The tendency identification process corresponds to weak identification processes (step S4) of calculating respective identification values $OUT_i$ from the multiple types of feature quantity data $C_i$ on the basis of the following equation (2). That is, the identification value OUT, is used to calculate the photoconductor surface contamination level (i.e., F value), but does not serve as a determinant of the photoconductor surface contamination level (i.e., F value).

$$OUT_i = sgn_i \times (c_i - b_i) \quad (2)$$

After the weak identification processes are performed on the multiple types of feature quantity data $C_i$, the data analysis unit 143 calculates the F value (step S5) from the following equation (3) with the weight $\alpha_i$ and the identification value $OUT_i$.

$$F = \Sigma(\alpha_i \times OUT_i) \quad (3)$$

The above-described identification threshold $b_i$, identification polarity $sgn_i$, and weight $\alpha_i$ are determined such that the labeled supervised data is appropriately learned, and that only the data corresponding to the abnormality predictive period has an F value of negative polarity. Therefore, if the F value calculated from the above equation (3) has negative polarity, the abnormality predictive period, i.e., a period immediately preceding the occurrence of an abnormal image caused by the contamination of the outer circumferential surface of the photoconductor 40 by the discharge products, is assumed.

If the F value thus has negative polarity (YES at step S6), the data analysis unit 143 calculates the operation time for which the corresponding copier 101 executes the preliminary photoconductor rotation operation (step S7) to improve the state of the outer circumferential surface of the photoconductor 40 contaminated by the discharge products. Then, an execution instruction to execute the preliminary photoconductor rotation operation for the calculated operation time is transmitted to the copier 101 from the data transmission unit 144 via the communication network (step S8). The execution instruction is received by the data reception unit 116 of the copier 101. In accordance with the execution instruction, the operation control unit 117 of the copier 101 controls the respective units to execute the preliminary photoconductor rotation operation.

Optionally, if the F value has negative polarity, the management apparatus 104 may cause the corresponding copier 101 to issue an abnormality predictive alarm via the communication network such as a telephone line, or may send an abnormality predictive alarm to the maintenance technician through electronic mail.

Further, multiple patterns of labeling the data of the normal period and the data of the abnormality predictive period may be prepared to calculate the F value with each of the labeling patterns. The level of the abnormal image in the abnormal image occurring period may be determined as a threshold for labeling the data of the normal period and the data of the abnormality predictive period. If the level of the abnormal image serving as the threshold is set to multiple values, it is possible to perform multiple patterns of labeling. Further, it is possible to calculate the preliminary photoconductor rotation operation time on the basis of the calculated multiple F values. For example, it is now assumed that three F values, i.e., a first F value, a second F value, and a third F value, are calculated by the multiple patterns of labeling. In this case, the preliminary photoconductor rotation operation time may be set to approximately 30 seconds, for example, if one or two of the three F values has(have) negative polarity, and the preliminary photoconductor rotation operation time may be set to approximately 90 seconds, for example, if all of the three F values have negative polarity.

Description will now be given of a modified example of the present embodiment, which uses not the above-described F value but a Mahlanobis distance D to represent the photoconductor surface contamination level. To obtain the Mahlanobis distance D, it is necessary to construct a normal group data set, which is a set of multiple types of group data acquired from the copier 101 in a normal state. The normal group data set may be constructed by the multiple types of status information (i.e., prediction-use information) acquired from a standard copier in a normal state having the same specifications as those of the copier 101, or may be constructed by the multiple types of status information acquired from the copier 101 immediately after the manufacturing of the copier 101 or in the initial operation of the copier 101.

In a case in which the normal group data set is constructed on the basis of the multiple types of status information acquired in the initial operation, the following processing is performed when a main power supply of the copier 101 shipped from a factory is first turned on at a location for use by a user.

The copier 101 executes a predetermined normal group data set construction processing program, to thereby accumulate in the RAM 1*b* the multiple types of status information in a normal state, and transmit the accumulated normal group data set to the management apparatus 104 via the communication network together with an identifier (ID) of the copier 101. During the operation of the copier 101, the n groups of status information each including the k number of information items considered to be related to the photoconductor surface contamination level of the copier 101 are acquired.

The following table 1 illustrates a data configuration of the acquired information. Under the first condition (e.g., the first date or the first copier 101), the k number of information items are acquired and labeled as $y_{11}, y_{12}, \ldots$, and $y_{1k}$. Similarly, the information items obtained under the next condition (e.g., the second date or the second copier 101) are labeled as $y_{21}, y_{22}, \ldots$, and $y_{2k}$. Thereby, the n groups of information are acquired.

TABLE 1

| | type of information (j) | | | |
|---|---|---|---|---|
| group number (i) | (1) | (2) | ... | (k) |
| 1 | $y_{11}$ | $y_{12}$ | ... | $y_{1k}$ |
| 2 | $y_{21}$ | $y_{22}$ | ... | $y_{2k}$ |
| ... | ... | ... | ... | ... |
| n | $y_{n1}$ | $y_{n2}$ | ... | $y_{nk}$ |
| mean ($\bar{y}$) | $\bar{y}_1$ | $\bar{y}_2$ | ... | $\bar{y}_k$ |
| standard deviation ($\sigma$) | $\sigma_1$ | $\sigma_2$ | ... | $\sigma_k$ |

In the normal group data set construction process, the status information acquisition unit 111 first acquires the k types of information $y_{11}, y_{12}, \ldots$, and $y_{1k}$ forming the group data of the first group. Then, the acquired information is stored in, for example, a RAM of the management apparatus 104 as the data of the first row of the data table. The status information acquisition unit 111 then acquires the k types of information $y_{21}, y_{22}, \ldots$, and $y_{2k}$ forming the group data of the second group. Then, the acquired data is stored in, for example, the RAM of the management apparatus 104 as the data of the second row of the data table. Thereafter, the group data of the third group and the subsequent groups is sequentially acquired with the print job and stored as the data of the data table. Then, the group data of the n-th group is acquired immediately before the lapse of a predetermined specified period. Thereby, the data up to the n-th row of the data table is stored in, for example, the RAM of the management apparatus 104.

Subsequently, data normalization is performed. Data normalization refers to a process for converting absolute value information of the multiple types of status information into variate information. Normalized data of the multiple types of status information is calculated on the basis of the relational expression in the following equation (4). In the relation expression, i indicates the group data of one of the n groups, and j indicates one of the k types of information.

$$Y_{ij}=(y_{ij}-y_i)/\sigma_j \tag{4}$$

After the data normalization, a correlation coefficient calculation process is performed. In the correlation coefficient calculation process, a correlation coefficient $r_{pq}$ is calculated on the basis of the following equation (5) for all combinations of two different types of data in the k types of normalized data in the n groups of normalized data.

$$r_{pq}=\Sigma(Y_{ip}-Y_{iq}/(\Sigma Y_{ip}^2\times\Sigma Y_{iq}^2)^{1/2} \tag{5}$$

With the correlation coefficient $r_{pq}$ calculated for all combinations of data items, a k-by-k correlation coefficient matrix R having p rows and q columns is constructed which includes diagonal elements represented as 1 and the remaining elements represented as $r_{pq}$. The correlation coefficient matrix R is illustrated in the following equation (6).

$$R=\begin{pmatrix} 1 & r_{12} & r_{13} & \ldots & r_{1k} \\ r_{21} & 1 & r_{23} & \ldots & r_{2k} \\ r_{31} & r_{32} & 1 & \ldots & r_{3k} \\ \ldots & \ldots & \ldots & \ldots & \ldots \\ r_{k1} & r_{k2} & r_{k3} & \ldots & 1 \end{pmatrix} \tag{6}$$

After the above-described correlation coefficient calculation process, a matrix transform process is performed. With the matrix transform process, the correlation coefficient matrix R illustrated in the above equation (6) is transformed into an inverse matrix A ($=R^{-1}$) illustrated in the following equation (7).

$$A=\begin{pmatrix} a_{11} & a_{12} & a_{13} & \ldots & a_{1k} \\ a_{21} & a_{22} & a_{23} & \ldots & a_{2k} \\ a_{31} & a_{32} & a_{33} & \ldots & a_{3k} \\ \ldots & \ldots & \ldots & \ldots & \ldots \\ a_{k1} & a_{k2} & a_{k3} & \ldots & a_{kk} \end{pmatrix}=R^{-1} \tag{7}$$

The copier 101 performs the normal group data set construction process of constructing the acquired data table corresponding to the normal group data set illustrated in the above table 1. Then, prior to the process of calculating the photoconductor surface contamination level and the process of calculating the preliminary photoconductor rotation operation time by the data analysis unit 143, the sequence of processes described above, i.e., the data normalization process, the correlation coefficient calculation process, and the matrix transform process, is performed to construct the inverse matrix A as the normal group data set. The inverse matrix A is then stored in, for example, the RAM of the management apparatus 104.

Figure 10:
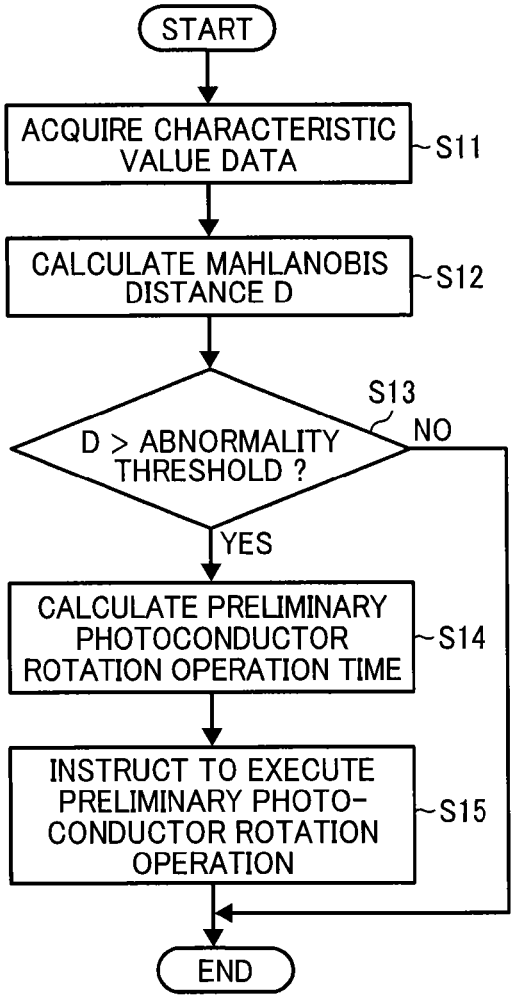
FIG. 10 is a flowchart illustrating processing performed by the data analysis unit of the management apparatus in a modified example.

FIG. 10 is a flowchart illustrating processing performed by the data analysis unit 143 of the management apparatus 104 in the present modified example. On the basis of the multiple types of status information (i.e., characteristic value data) transmitted from the copier 101 at a predetermined time, the data analysis unit 143 of the management apparatus 104 performs processes such as the process of calculating the photoconductor surface contamination level and the process of calculating the preliminary photoconductor rotation operation time. In the present modified example, the data analysis unit 143 acquires the k types (e.g., approximately 40 types) of status information acquired by the status information acquisition unit 111 of each of the copiers 101 (step S11), and calculates the Mahlanobis distance D in a multidimensional space formed by the inverse matrix A of group data including combinations of all or part of the k types of status information (step S12).

Specifically, the data analysis unit 143 first acquires the k types of characteristic value data $x_1, x_2, \ldots$, and $x_k$, which correspond to the above-described k types of information $y_{11}, y_{12}, \ldots$, and $y_{1k}$. The data analysis unit 143 then standardizes the acquired characteristic value data by using the following equation (8). Herein, the standardized characteristic value data is represented as $X_1, X_2, \ldots$, and $X_k$.

$$X_j(x_j-y_j)/\alpha_j \tag{8}$$

Then, the data analysis unit 143 calculates an index value $D^2$ from the following equation (9) determined by the use of the element $a_{kk}$ of the already obtained inverse matrix A. In the equation (9), Σ represents the sum of values concerning the suffixes p and q.

$$D^2=(1/k)\times\Sigma(a_{pq}\times X_p\times X_p) \tag{9}$$

The data analysis unit 143 compares the thus-calculated Mahlanobis distance D with a preset abnormality threshold (step S13). Then, if the Mahlanobis distance D is greater than the abnormality threshold (YES at step S13), it is determined that the acquired group data is abnormal data substantially deviating from a normal distribution. In this case, the data analysis unit 143 calculates the operation time for which the corresponding copier 101 executes the preliminary photoconductor rotation operation (step S14) to improve the state of the outer circumferential surface of the photoconductor 40 contaminated by the discharge products. Then, an execution instruction to execute the preliminary photoconductor rotation operation for the calculated operation time is transmitted to the copier 101 from data transmission unit 144 via the communication network (step S15). The execution instruction is received by the data reception unit 116 of the copier 101. In accordance with the execution instruction, the operation control unit 117 of the copier 101 controls the respective units to execute the preliminary photoconductor rotation operation.

Alternatively, the acquired data table constructed by the normal group data set construction process or the normalized data table or the correlation coefficient matrix R obtained during the inverse matrix construction process, for example, may be stored as the normal group data set in place of the inverse matrix A. If one of these normal group data sets is stored in place of the inverse matrix A, the inverse matrix A may be constructed on the basis of the data of the normal group data set prior to the abnormality determination. In the above-described example, the normal group data set is constructed in the initial operation of the copier 101. Alternatively, the normal group data set constructed on the basis of data acquired from a standard copier having the same specifications as those of the present copier 101 may previously be stored in, for example, the RAM of the management apparatus 104.

Description will now be given of the process of calculating the preliminary photoconductor rotation operation time (step S7 or S14). Description will first be given of an experiment example in which, in a high-humidity environment under various conditions with different rest times or different humidities and temperatures, A3-size halftone images are output by the copier 101 powered on after a rest time following an extended image forming operation. In the extended image forming operation prior to the power-on of the copier 101 in this experiment example, the charging device 60 including a corona charger is operated for a time taken to perform an image forming operation for making 200,000 copies, and the photoconductor 40 is operated for a time taken to perform an image forming operation for making 300,000 copies.

Figure 11:
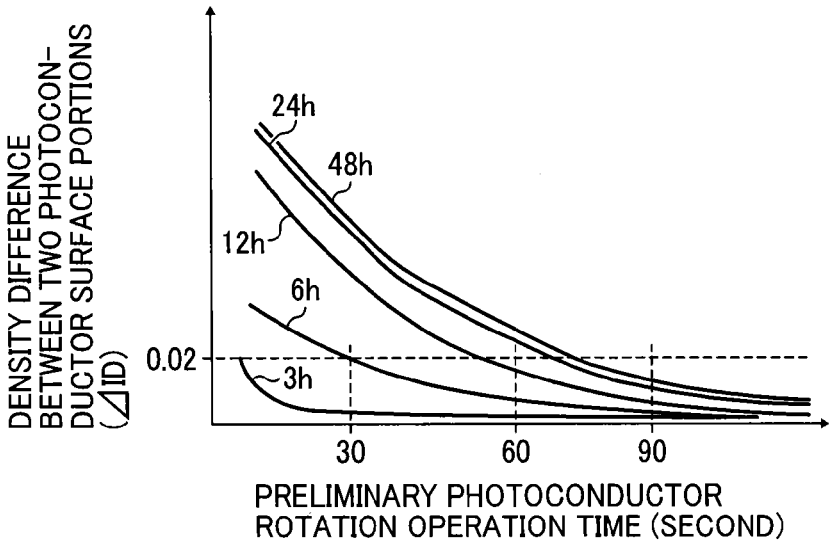
FIG. 11 is a graph illustrating measurement results of a density difference between a halftone image density in a photoconductor surface portion facing the charging device and a halftone image density in a photoconductor surface portion not facing the charging device during a rest time after an extended image forming operation and before a preliminary photoconductor rotation operation, with the rest time set to different values.
Figure 12:
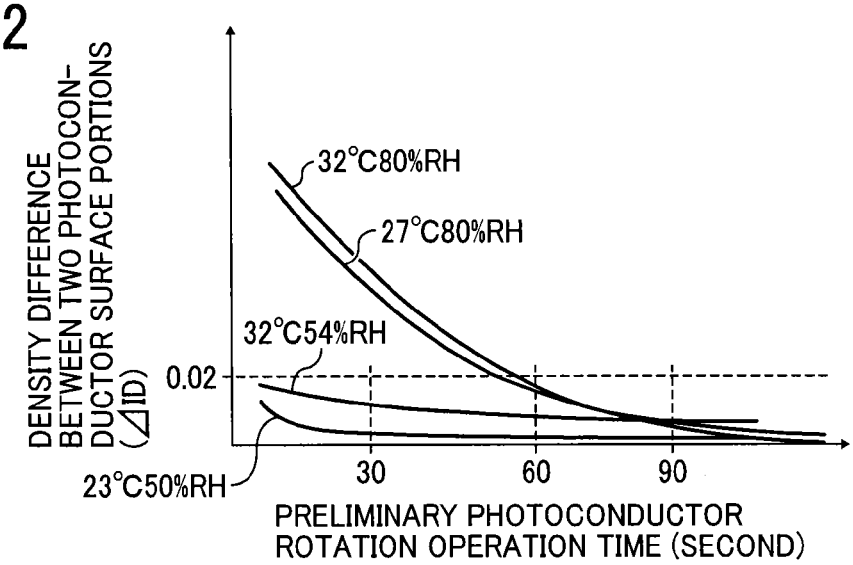
FIG. 12 is a graph illustrating measurement results of a density difference between a halftone image density of a photoconductor surface portion facing the charging device and a halftone image density of a photoconductor surface portion not facing the charging device during a rest time after an extended image forming operation and before a preliminary photoconductor rotation operation, with temperature and humidity set to different values.

FIGS. 11 and 12 are graphs each illustrating measurement results of a density difference ΔID between a halftone image density in a photoconductor surface portion facing the charging device 60 and a halftone image density in a photoconductor surface portion not facing the charging device 60 during a rest time after an extended image forming operation and before a preliminary photoconductor rotation operation preceding an image forming operation in the above-described experiment example.

In the photoconductor surface portion facing the charging device 60 during the rest time, the adhesion of the discharge products generated by the charging device 60 is noticeable, and the outer circumferential surface of the photoconductor 40 is contaminated by the discharge products. Meanwhile, in the photoconductor surface portion not facing the charging device 60 during the rest time, the adhesion amount of the discharge products generated by the charging device 60 is relatively small, and an abnormal image due to the discharge products is barely observed. Accordingly, if these photoconductor surface portions are compared and the difference in image density therebetween is relatively small, it is considered that the contamination level of the photoconductor surface portion facing the charging device 60 during the rest time is substantially low. A density difference ΔID of approximately 0.02 or less is an acceptable level for the market, at which the abnormal image is not visually perceptible. In the present embodiment, therefore, a range not exceeding the density difference ΔID of 0.02 is determined as an allowable range.

As illustrated in FIGS. 11 and 12, an increase of the preliminary photoconductor rotation operation time results in a gradual reduction of the density difference ΔID and thus a reduction of the photoconductor surface contamination level in the photoconductor surface portion facing the charging device 60 during the rest time. As illustrated in FIG. 11, however, the preliminary photoconductor rotation operation time taken for the density difference ΔID to fall within the allowable range thereof, i.e., the preliminary photoconductor rotation operation time taken for the photoconductor surface contamination level to fall within the allowable range thereof, varies depending on the rest time. Specifically, an increase of the rest time results in an increase of the preliminary photoconductor rotation operation time taken for the photoconductor surface contamination level to fall within the allowable range. Similarly, as illustrated in FIG. 12, the preliminary photoconductor rotation operation time taken for the density difference ΔID to fall within the allowable range thereof, i.e., the preliminary photoconductor rotation operation time taken for the photoconductor surface contamination level to fall within the allowable range thereof, varies depending on the temperature and humidity. Specifically, an increase of the temperature and humidity results in an increase of the preliminary photoconductor rotation operation time taken for the photoconductor surface contamination level to fall within the allowable range.

Figure 13:
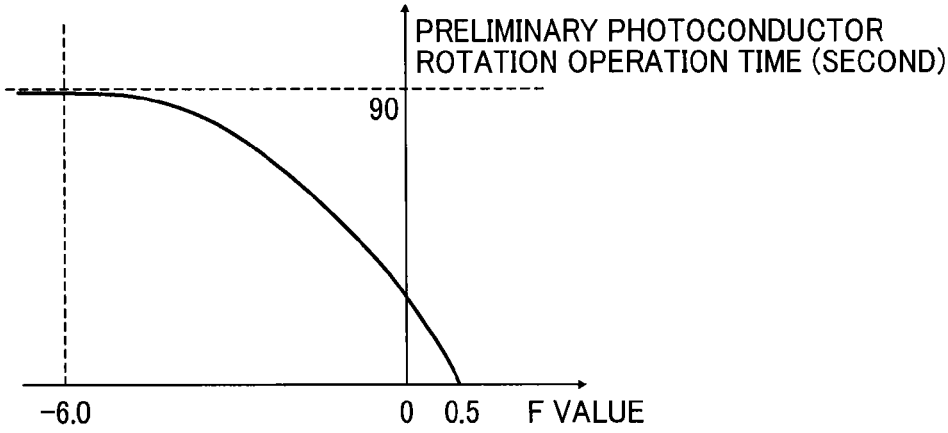
FIG. 13 is a graph illustrating the relationship between an F value and a preliminary photoconductor rotation operation time taken for the photoconductor surface contamination level to fall within an allowable range.

FIG. 13 is a graph illustrating the relationship between the F value and the preliminary photoconductor rotation operation time taken for the photoconductor surface contamination level to fall within the allowable range. The graph illustrates an approximate equation obtained by approximating the data by the least squares method. The approximate equation is expressed by the following equation (10), in which m represents an order.

$$y=a_1x^m+a_2x^{m-1}+\ldots+a_mx+a_{m+1} \tag{10}$$

With an increase in amount of the discharge products adhering to the outer circumferential surface of the photoconductor 40 (i.e., with an increase in contamination of the outer circumferential surface of the photoconductor 40), the F value is reduced (i.e., increased toward the negative direction). According to the relationship illustrated in FIG. 13, therefore, the preliminary photoconductor rotation operation time is set to be increased in accordance with the increase in absolute value of the negative F value. Specifically, the preliminary photoconductor rotation operation time is calculated from the F value and the approximate equation expressed by the above equation (10). In the present embodiment, however, the preliminary photoconductor rotation operation time is set in a range from 0 second to 90 seconds.

The present embodiment allows analyzers to perform analysis on the basis of the maintenance information and the status information, and generate a new approximate equation representing the relationship between the F value and the preliminary photoconductor rotation operation time in consideration of the status information of the copiers 101 released on the market. The generated new approximate equation may be input to the analysis computer 106 and transmitted to the management apparatus 104 via the LAN. Accordingly, it is possible to update the analysis program for calculating the preliminary photoconductor rotation operation time stored in the data storage unit 142 of the management apparatus 104, and calculate the preliminary photoconductor rotation operation time by using the new approximate equation reflecting the latest status information of the copiers 101 released on the market. The calculation of the preliminary photoconductor rotation operation time is similarly performed also in the case in which the Mahlanobis distance D is used in place of the F value.

The above-described embodiments and effects thereof are illustrative only and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A management apparatus that communicates, via a communication network, with multiple image forming apparatuses each uniformly charging a surface of a latent image carrier to a predetermined charge potential, forming an electrostatic latent image on the charged surface of the latent image carrier, and developing the electrostatic latent image and forming a visible image to be transferred onto a recording medium, the management apparatus comprising:

a prediction-use information reception device configured to receive, from each of the multiple image forming apparatuses via the communication network, prediction-use information for predicting a latent image carrier surface contamination level due to discharge products generated during the charging;

a latent image carrier surface contamination level prediction device configured to execute, on the basis of the received prediction-use information, a prediction process of predicting the latent image carrier surface contamination level of the image forming apparatus corresponding to the prediction-use information and generating a predicted latent image carrier surface contamination level; and an execution instruction transmission device configured to, if the predicted latent image carrier surface contamination level exceeds a predetermined allowable range, transmit an execution instruction to execute a contamination reduction operation of reducing the contamination of the surface of the latent image carrier due to the discharge products to the image forming apparatus corresponding to the latent image carrier surface contamination level via the communication network, wherein, if the predicted latent image carrier surface contamination level exceeds the predetermined allowable range, the execution instruction transmission device calculates a length of operation of the contamination reduction operation on the basis of the latent image carrier surface contamination level, and transmits the execution instruction to execute the contamination reduction operation for the calculated length of operation to the image forming apparatus corresponding to the latent image carrier surface contamination level.

2. An image forming apparatus maintenance system comprising:

multiple image forming apparatuses each including a rotary latent image carrier, a charging device configured to uniformly charge a surface of the latent image carrier to a predetermined charge potential, an electrostatic latent image forming device configured to form an electrostatic latent image on the charged surface of the latent image carrier, a development device configured to develop the electrostatic latent image and form a visible image to be transferred onto a recording medium, a prediction-use information acquisition and transmission device configured to acquire, at predetermined intervals, prediction-use information useful for predicting a latent image carrier surface contamination level due to discharge products generated during the charging, and externally transmit the prediction-use information, and a contamination reduction device configured to receive an externally transmitted execution instruction to execute a contamination reduction operation, and execute, in accordance with the execution instruction, the contamination reduction operation of reducing the contamination of the surface of the latent image carrier due to the discharge products; and a management apparatus configured to communicate with the multiple image forming apparatuses via a communication network, the management apparatus including a prediction-use information reception device configured to receive the prediction-use information transmitted from each of the multiple image forming apparatuses via the communication network, a latent image carrier surface contamination level prediction device configured to execute, on the basis of the received prediction-use information, a prediction process of predicting the latent image carrier surface contamination level of the image forming apparatus corresponding to the prediction-use information and generating a predicted latent image carrier surface contamination level, and an execution instruction transmission device configured to, if the predicted latent image carrier surface contamination level exceeds a predetermined allowable range, transmit the execution instruction to execute the contamination reduction operation to the image forming apparatus corresponding to the latent image carrier surface contamination level via the communication network, wherein, if the predicted latent image carrier surface contamination level exceeds the predetermined allowable range, the execution instruction transmission device calculates a length of operation of the contamination reduction operation on the basis of the latent image carrier surface contamination level, and transmits the execution instruction to execute the contamination reduction operation for the calculated length of operation to the image forming apparatus corresponding to the latent image carrier surface contamination level.

3. The image forming apparatus maintenance system according to claim 2, wherein the management apparatus further includes a prediction process updating device configured to update the prediction process on the basis of the prediction-use information in a predetermined period preceding the occurrence of an abnormal image caused by the contamination of the surface of the latent image carrier by the discharge products.

4. The image forming apparatus maintenance system according to claim 2, wherein the prediction-use information acquisition and transmission device acquires the prediction-use information at least at one of when the image forming apparatus is powered on, when the image forming apparatus returns from an energy-saving mode, and when a predetermined specified time lapses after the completion of an image forming operation and before the start of a subsequent image forming operation.

5. The image forming apparatus maintenance system according to claim 2, wherein the latent image carrier surface contamination level prediction device performs multiple weak identification processes of calculating preliminary prediction values from the received prediction-use information, and predicts the latent image carrier surface contamination level by using the calculated preliminary prediction values.

6. The image forming apparatus maintenance system according to claim 5, wherein the latent image carrier surface contamination level prediction device weights the calculated preliminary prediction values, and predicts the latent image carrier surface contamination level by using the weighted preliminary prediction values.

7. The image forming apparatus maintenance system according to claim 6, wherein the latent image carrier surface contamination level prediction device derives weighted prediction results from the weighted preliminary prediction values, and predicts the latent image carrier surface contamination level on the basis of combinations of the weighted prediction results.

8. The image forming apparatus maintenance system according to claim 2, wherein the management apparatus further includes a modification device configured to modify, for each of the image forming apparatuses, the process of calculating the length of operation of the contamination reduction operation.

9. The image forming apparatus maintenance system according to claim 2, wherein the management apparatus further includes a relationship information storage device configured to store relationship information concerning the relationship between the latent image carrier surface contamination level and the length of operation of the contamination reduction operation according to the latent image carrier surface contamination level, wherein, if the predicted latent image carrier surface contamination level exceeds the predetermined allowable range, the execution instruction transmission device calculates the length of operation of the contamination reduction operation on the basis of the latent image carrier surface contamination level and the stored relationship information.

10. A management method that manages, via a communication network, multiple image forming apparatuses each uniformly charging a surface of a latent image carrier to a predetermined charge potential, forming an electrostatic latent image on the charged surface of the latent image carrier, and developing the electrostatic latent image and forming a visible image to be transferred onto a recording medium, the management method comprising:

receiving, from each of the multiple image forming apparatuses via the communication network, prediction-use information for predicting a latent image carrier surface contamination level due to discharge products generated during the charging;

executing, on the basis of the received prediction-use information, a prediction process of predicting the latent image carrier surface contamination level of the image forming apparatus corresponding to the prediction-use information and generating a predicted latent image carrier surface contamination level;

calculating, if the predicted latent image carrier surface contamination level exceeds a predetermined allowable range, a length of operation of a contamination reduction operation which reduces the contamination of the surface of the latent image carrier due to the discharge products, on the basis of the latent image carrier surface contamination level; and transmitting an execution instruction to execute the contamination reduction operation for the calculated length of operation to the image forming apparatus corresponding to the latent image carrier surface contamination level via the communication network, wherein, if the predicted latent image carrier surface contamination level exceeds the predetermined allowable range, the transmitting calculates a length of operation of the contamination reduction operation on the basis of the latent image carrier surface contamination level, and transmits the execution instruction to execute the contamination reduction operation for the calculated length of operation to the image forming apparatus corresponding to the latent image carrier surface contamination level.

* * * * *